United States Patent [19]

Aono et al.

[11] Patent Number: 4,636,455

[45] Date of Patent: Jan. 13, 1987

[54] HEAT DEVELOPEMENT DYE-TRANSFER PROCESS USING CROSSLINKED BINDERS WITH DYE MORDANTS

[75] Inventors: Toshiaki Aono; Koichi Nakamura; Takeshi Shibata; Taku Nakamura, all of Kanagawa, Japan

[73] Assignee: Fuji Photo Film Co., Ltd., Kanagawa, Japan

[21] Appl. No.: 801,183

[22] Filed: Nov. 22, 1985

[30] Foreign Application Priority Data

Nov. 30, 1984 [JP] Japan ..... 59-253730

[51] Int. Cl.[4] ..... G03C 5/54; G03C 1/40

[52] U.S. Cl. ..... 430/203; 430/213

[58] Field of Search ..... 430/203, 213

[56] References Cited

U.S. PATENT DOCUMENTS 3,625,694 12/1971 Cohen et al. ..... 430/941
3,859,096 1/1975 Burness et al. ..... 430/213
4,500,626 2/1985 Naito et al. ..... 430/203
4,559,290 12/1985 Sawada et al. ..... 430/203

FOREIGN PATENT DOCUMENTS 0121765 10/1984 European Pat. Off. ..... 430/203
0123892 11/1984 European Pat. Off. ..... 430/203

*Primary Examiner*—Richard L. Schilling
*Attorney, Agent, or Firm*—Sughrue, Mion, Zinn, Macpeak, and Seas

[57] ABSTRACT

A novel process for transferring a diffusible dye to a dye fixing material by the steps of (a) applying water to a dye fixing material at least having a mordant and a binder on a support, (b) attaching the dye fixing material to a diffusible dye-containing material, and (c) heating the attached materials to transfer the dye from the dye-containing material to the dye fixing material, wherein the binder contains a cross-linked hydrophilic polymer and a non-cross-linked hydrophilic polymer and the amount of water applied to the dye fixing material is not more than the amount required to maximally swell the layer coated on the dye fixing material.

The dye fixing material of the present invention is capable of absorbing a sufficient amount of water in a short period of time, in the process of the present invention, to provide a dye-transferred image of high density in the dye fixing material after heating for a short time, which is substantially free from mottle or color bleeding.

9 Claims, No Drawings

HEAT DEVELOPEMENT DYE-TRANSFER PROCESS USING CROSSLINKED BINDERS WITH DYE MORDANTS

FIELD OF THE INVENTION

The present invention relates to a dye-transfer process for formation of a color image on a dye fixing material, wherein a diffusible dye formed or released by heat development is transferred to a dye fixing material in the presence of a small amount of water, and in particular, to a dye-transfer process capable of producing a color image of high density in a short period of time.

BACKGROUND OF THE INVENTION

Silver halide-based photography has conventionally been most widely used since the photographic characteristics of silver halide systems, such as sensitivity, gradation control, etc., are superior to those of other conventional photographic systems, such as electrophotography or the diazo process.

Recently, an improved photographic technique has been developed capable of simply and rapidly forming an image, in which development of a silver halide photographic material is carried out using a dye process under heat instead of a conventional wet process using a developing agent or the like.

Photographic materials for heat development using silver halides are well known in this technical field, and various photographic materials for heat development and processes are described, for example, in *Bases of Photographic Industry,* pp. 553–555 (Corona Publishing, 1979); *Image Information,* p. 40 (April, 1978); *Nebletts Handbook of Photography and Reprography,* pp. 32 and 33 (7th Ed., Van Nortrand Reinhold Company); U.S. Pat. Nos. 3,152,904, 3,301,678, 3,392,020 and 3,457,075, British Pat. Nos. 1,131,108 and 1,167,777, and *Research Disclosure* (June, 1978), pp. 9–15 (RD-17029).

Several processes have been proposed for formation of color images by heat development. For instance, U.S. Pat. Nos. 3,531,286, 3,761,270 and 4,021,240, Belgian Pat. No. 802,519 and *Research Disclosure* (September, 1975), pp. 31–32 describe processes for formation of color images by combination of an oxidized developing agent and a coupler and various kinds of developing agents which may be used.

*Research Disclosure* (May, 1978), pp. 54–58 (RD-16966) describes a process where a nitrogen-containing heterocyclic group is introduced in a dye to form a silver salt and the formed dye is released by heat development.

*Research Disclosure* (April, 1976), pp. 30–32 (RD-14433) and (December, 1976), pp. 14–15 (RD-15227) and U.S. Pat. No. 4,235,957 describe a heat-sensitive silver dye bleaching process for formation of positive color images, and various methods for bleaching useful dyes.

U.S. Pat. Nos. 3,985,565 and 4,022,617 describe a process for formation of a color image by utilizing a leuco dye.

However, the known processes for formation of color images have the disadvantage that the color images formed are apt to discolor or white background is apt to color due to coexisting silver halide, silver complex, developing agent, etc., during preservation for a long period of time. Other color image formation processes by heat development have been proposed in order to overcome this defect, e.g., those described in Japanese Patent Application (OPI) Nos. 179840/82 (corresponding to U.S. Pat. No. 4,463,079), 186774/82 (corresponding to U.S. Pat. No. 4,474,867), 198458/82 (corresponding to U.S. Pat. No. 4,478,927), 207250/82 (corresponding to U.S. Pat. No. 4,507,380), 58543/83 (corresponding to U.S. Pat. No. 4,500,626), 79247/83 (corresponding to U.S. Pat. No. 4,483,914), 116537/83 (corresponding to U.S. Pat. No. 4,439,513), 149046/83, 48764/84, 65839/84 (corresponding to European Patent Application No. 106,211A), 71046/84 (corresponding to European Patent Application No. 106,357A), 87450/84, 88730/84 and 164551/84 (corresponding to European Patent Application No. 121,765A) (the term "OPI" as used herein refers to a "published unexamined Japanese patent application").

These publications describe a dye-transfer process where a diffusible dye is formed or released when a light-sensitive silver halide and/or organic silver salt is reduced to silver by heat development in correspondence or countercorrespondence with the reduction reaction, and the diffusible dye is transferred to a dye fixing material.

In such dye-transfer processes, in general, a small amount of water is applied to a dye fixing material to swell the material and the swollen dye fixing material is then closely attached to a diffusible dye-containing material and heated to transfer the dye to the dye fixing material. Accordingly, if the amount of water applied to the dye fixing material is too small, a long period of time is required for the dye-transferring operation, often resulting in the appearance of transferred dye mottles. However, if the amount of water applied is increased in order to shorten the time for the dye-transferring operation, it is apparent that the time required for water application will have to be long. On the other hand, if a dye fixing material is swollen with water and then directly attached to a photographic material, without removing excess water existing on the surface of the dye fixing material with a roller or the like, the transferred dye will often bleed out on the surface of the material, resulting in decreased sharpness of the formed color image, although a color image of high density may be obtained in a relatively short period of time.

In a dye-transfer process, as mentioned above, the transferred color image often locally bleeds out, since the water-swollen layer in the dye fixing material is often in an unstable state during the dye-transferring operation. In order to overcome this problem, Japanese Patent Application (OPI) No. 164551/84 (corresponding to European Patent Application No. 121,765A) has proposed that the amount of water applied to the dye fixing material in the dye-transfer procedure is restricted to an amount equal to (the weight of water corresponding to the maximum swollen volume of the total coated layers of both the diffusible dye-containing photographic material and the dye fixing material) minus (the weight of the total coated layers) or less. According to this method, however, a long period of time is required for the coated layer of the dye fixing material to absorb a sufficient amount of water which is necessary in order to attain a sufficiently rapid dye-transferring with reduced mottle, using this amount of water.

On the other hand, Japanese Patent Application (OPI) No. 165056/84 (corresponding to U.S. patent Ser. No. 588,416, filed on Aug. 12, 1984, which already was abandoned) describes that various hydrophilic polymers can be used alone or in combination of two or more of them as a binder for dye fixing materials, but it does not specifically describe that a cross-linked hydrophilic polymer and a non-cross-linked hydrophilic polymer are used in combination with each other.

Therefore, no satisfactory dye-transfer process could be realized as yet.

SUMMARY OF THE INVENTION

Accordingly, the main object of the present invention is to provide a novel dye-transfer process capable of forming color images of high density with reduced mottle and color bleeding caused by water absorption in a short period of time followed by heat treatment for a short period of time.

The present invention therefore provides a novel process for transferring a diffusible dye to a dye fixing material comprising the steps of:

(a) applying water to a dye fixing material comprising a support having provided thereon at least a mordant and a binder, (b) contacting the dye fixing material with a diffusible dye-containing material, and (c) heating the contacted materials to transfer a dye from the dye-containing material to the dye fixing material, wherein the binder contains a cross-linked hydrophilic polymer and a non-cross-linked hydrophilic polymer and the amount of water applied to the dye fixing material is not more than that required to maximally swell the layer coated on the dye fixing material.

DETAILED DESCRIPTION OF THE INVENTION

According to the dye-transfer process of the present invention, a dye fixing material which may absorb a large amount of water in a short period of time is used and the amount of water applied to the dye fixing material is restricted to not more than the amount required to maximally swell the layer coated on the dye fixing material. In particular, the dye fixing material of the present invention is capable of absorbing a sufficient amount of water in a short period of time, and therefore, a transferred dye image of high density may be omitted after heating the material for a short period of time, which is free from mottle or color bleeding.

The water absorption characteristics of the dye fixing material used in the present invention result from its coated layer containing a binder comprising both a cross-linked hydrophilic polymer and a non-cross-linked hydrophilic polymer.

The binder-containing layer is preferably a dye fixing layer which contains a mordant, or the binder may be incorporated in one or more auxiliary layers (such as a subbing layer, an intermediate layer, a protective layer, a matt agent layer, a peeling layer, etc.) which are provided on the same surface of the support as the dye fixing layer. In any case, it is necessary that both of the polymers be contained in the same layer coated on a support.

As used herein, the term "cross-linked hydrophilic polymer" means a hydrophilic polymer contained in the layer coated on a dye fixing material, that is, cross-linked by a cross-linking agent, and the term "non-cross-linked polymer" refers to a hydrophilic polymer which is not cross-linked by the cross-linking agent.

Examples of cross-linked hydrophilic polymers used in the present invention include those comprising monomer units of the general formula (I):

$$\text{-}(A)_x\text{-}(B)_y\text{-}(C)_z \qquad (I)$$

In the above formula (I), A represents a monomer unit having a nucleophilic reactive group such as a primary or secondary amino group, a phenolic hydroxy group, an active methylene group or a sulfinic acid group; B represents a monomer unit having an electrophilic reactive group such as an aldehyde group, an active halogen group, an active vinyl group, an active ester group, an epoxy group or an N-methylol group; and C represents a hydrophilic monomer unit having a hydrophilic group such as a hydroxy group, a carboxylic acid group or a salt thereof, an amido group, a sulfonic acid group or a salt thereof or a lactam group; x is 0 to 50 mol%; y is 0 to 50 mol%; z is 20 to 99 mol%; with the proviso that $x+y \geqq 1$ mol%. The hydrophilic polymers of the formula (I) may additionally contain an oleophilic comonomer unit in an amount that does not reduce the water solubility of said polymers.

Examples of specific hydrophilic polymers according to formula (I) containing monomer unit (A) include gelatin and polylysine and polymers of the following formulae, although the present invention is not to be construed as being limited thereto:

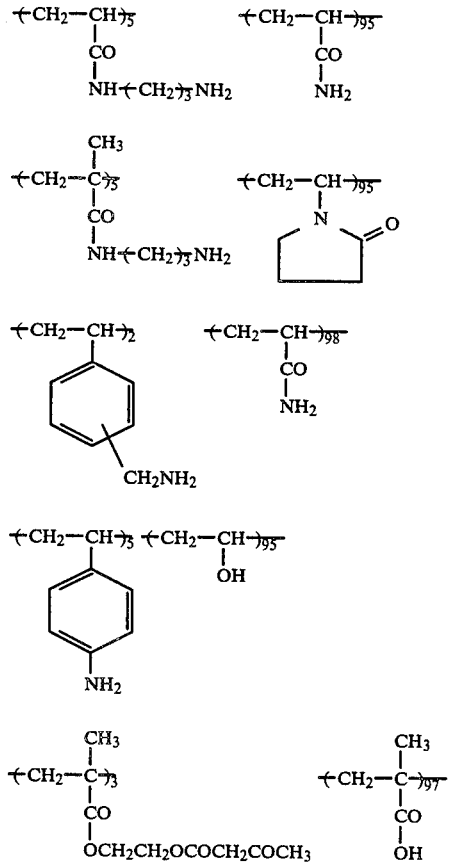

-continued

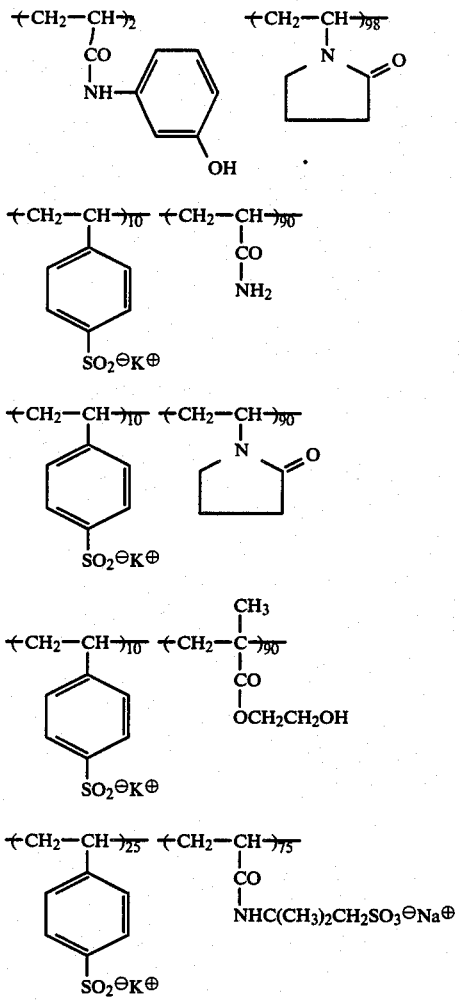

These may be used in the present invention alone or in a combination of two or more of them.

In particular, gelatin is especially preferred among the above mentioned hydrophilic polymers.

As to gelatin, a lime-processed gelatin and an acid-processed gelatin as well as an enzyme-processed gelatin as described in *Bull. Soc. Phot. Japan,* No. 16, p. 30 (1966) may be used, and in addition, hydrolyzed or enzyme-decomposed gelatin may also be used in the present invention.

Gelatin derivatives which may be used in the present invention include those obtained by reaction of gelatin and an acid halide, an acid anhydride, an isocyanate, a bromoacetic acid, an alkanesultone, a vinylsulfonamide, a maleinimide, a polyalkylene oxide, an epoxy or a similar compound. Examples of such gelatin derivatives are described, e.g., in U.S. Pat. Nos. 2,614,928, 3,132,945, 3,186,846 and 3,312,553, British Pat. Nos. 861,414, 1,033,189 and 1,005,784, and Japanese Patent Publication No. 26845/67.

Gelatin graft polymers which may be used in the present invention include those obtained by grafting a gelatin with a homo- or copolymer of a vinyl monomer such as an acrylic acid or methacrylic acid or an ester or amide derivative thereof, or an acrylonitrile or styrene. In particular, especially preferred gelatin graft polymers are obtained by grafting a gelatin with a polymer which is compatible with a gelatin in some degree such as a polymer of an acrylic acid, methacrylic acid, acrylamide, methacrylamide or hydroxyalkyl methacrylate. Examples of such graft polymers are described, e.g., in U.S. Pat. Nos. 2,763,625, 2,831,767 and 2,956,884.

When a hydrophilic polymer containing monomer unit (A) is used in the present invention, the cross-linking agent used together with the polymer is a compound having at least two electrophilic reactive groups. Preferred examples of such cross-linking agents include aldehyde compounds such as formaldehyde and glutaraldehyde; ketone compounds such as diacetyl and cyclopentanedione; reactive halogen-containing compounds such as bis(2-chloroethylurea), 2-hydroxy-4,6-dichloro-1,3,5-triazine and those described in U.S. Pat. Nos. 3,288,775 and 2,732,303 and British Pat. Nos. 974,723 and 1,167,207; reactive olefin-containing compounds such as divinylsulfone, 5-acetyl-1,3-diacryloylhexahydro-1,3,5-triazine and those described in U.S. Pat. Nos. 3,635,718 and 3,232,763, British Pat. No. 994,869 and *Research Disclosure* (October, 1978), pp. 64–66 (RD-17458); N-methylol compounds such as N-hydroxymethylphthalimide and those described in U.S. Pat. Nos. 2,732,316 and 2,586,168; isocyanates as described in U.S. Pat. No. 3,103,437; aziridine compounds as described in U.S. Pat. Nos. 3,017,280 and 2,983,611; acid derivatives as described in U.S. Pat. Nos. 2,725,294 and 2,725,295; carbodiimide compounds as described in U.S. Pat. No. 3,100,704; epoxy compounds as described in U.S. Pat. No. 3,091,537; isoxazole compounds as described in U.S. Pat. Nos. 3,321,313 and 3,543,292; halogenocarboxyaldehydes such as mucochloric acid; dioxane derivatives such as dihydroxydioxane and dichlorodioxane; dihydroxyquinoline compounds described in Japanese Patent Application (OPI) No. 38540/75; phosphorus-halogen bond-containing compounds as described in Japanese Patent Application (OPI) No. 113929/83; N-sulfonyloximide compounds as described in Japanese Patent Application (OPI) No. 93470/77; N-acyloximino compounds as described in Japanese Patent Publication No. 22089/78; N-carbonyloximide compounds as described in Japanese Patent Application (OPI) No. 43353/81; 2-sulfonyloxypyridinium salts as described in Japanese Patent Application (OPI) No. 110762/81; N-carbamoylpyridinium salts as described in Japanese Patent Application (OPI) Nos. 51945/74 and 59625/76. In addition, inorganic cross-linking agents such as chromium alum and zirconium sulfate may also be used. Furthermore, cross-linking agent precursors may also be used, instead of these cross-linking agents, such as alkali metal bisulfite-aldehyde adducts, hydantoin-methylol derivatives, primary aliphatic nitroalcohols, mesyloxyethylsulfonyl compounds and chloroethylsulfonyl compounds.

In particular, reactive halogen-containing compounds and reactive olefin-containing compounds are especially preferred, among the above described cross-linking agents.

Examples of other hydrophilic polymers of the formula (I) containing the above described monomer units (B) include dialdehyde-starch and those of the following formulae, although the present invention is not to be construed as being limited thereto:

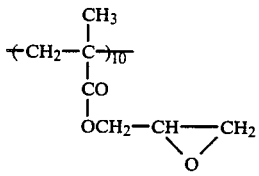

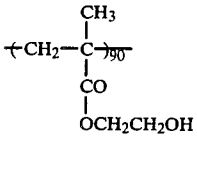

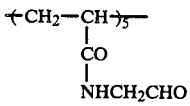

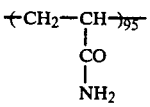

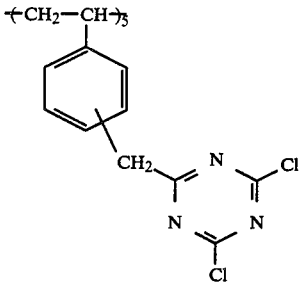

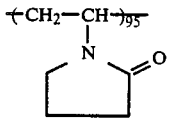

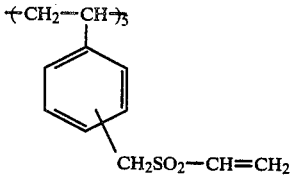

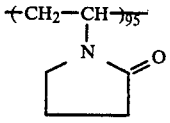

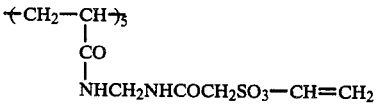

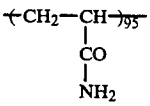

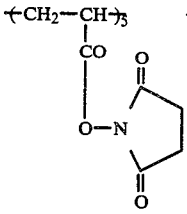

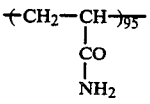

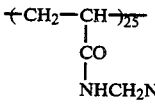

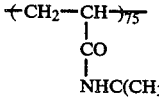

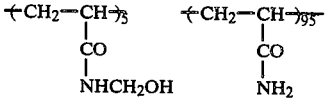

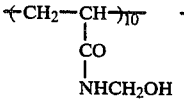

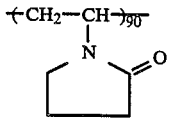

-continued

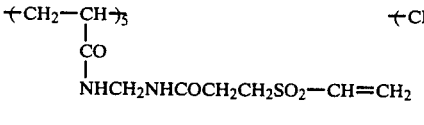

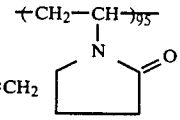

These may be used in the present invention alone or in a combination of two or more of them.

In particular, among this class of hydrophilic polymers those containing vinylsulfonyl-containing monomers as the monomer unit (B) are especially preferred.

When a hydrophilic polymer according to formula (I) containing monomer unit (B) is used in the present invention, the cross-linking agent used together with the polymer is a compound having at least two nucleophilic reactive groups. Preferred examples of such cross-linking agents include diamines such as ethylenediamine, propylenediamine, 1,3-propanediamine, 1,5-diaminopentane, diethylenetriamine and triethylenetetramine; polyamines such as polyethylenediamine; disulfinic acids such as potassium 2-butene-1,4-disulfinate; and polysulfinic acids such as polyvinylbenzenesulfinic acid. In particular, diamines (especially 1,3-propanediamine) and polysulfinic acids are preferred.

The non-cross-linked hydrophilic polymers which are incorporated in the binder of the dye fixing material of the present invention together with the above described cross-linked hydrophilic polymers are hydrophilic polymers which have hydrophilic monomer units containing a hydrophilic group such as hydroxy group, a carboxylic acid group or a salt thereof, a sulfonic acid group or a salt thereof or a lactam group, but not containing any reactive group capable of being cross-linked with the cross-linking agent used for the cross-linked hydrophilic polymers. These non-cross-linked hydrophilic polymers may additionally contain an oleophilic comonomer unit in an amount that does not reduce the water solubility of the polymers.

Preferred examples of non-cross-linked hydrophilic polymers which may be used in the present invention include natural polymers and derivatives thereof such as starch, dextran, gum arabic, hydroxyethyl cellulose, carboxymethyl cellulose, hydroxypropyl cellulose, guar gum, locust bean gum and pullulan; polyethers such as polyethylene glycol and polypropylene glycol; and vinyl polymers having a hydrophilic group, in the side chain thereof, such as a hydroxy group, a carboxylic acid group or a salt thereof, an amido group, a sulfonic acid group or a salt thereof, or a lactam group, including, for example, those of the following formulae:

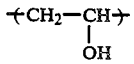

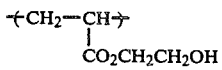

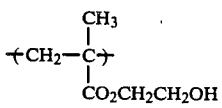

-continued

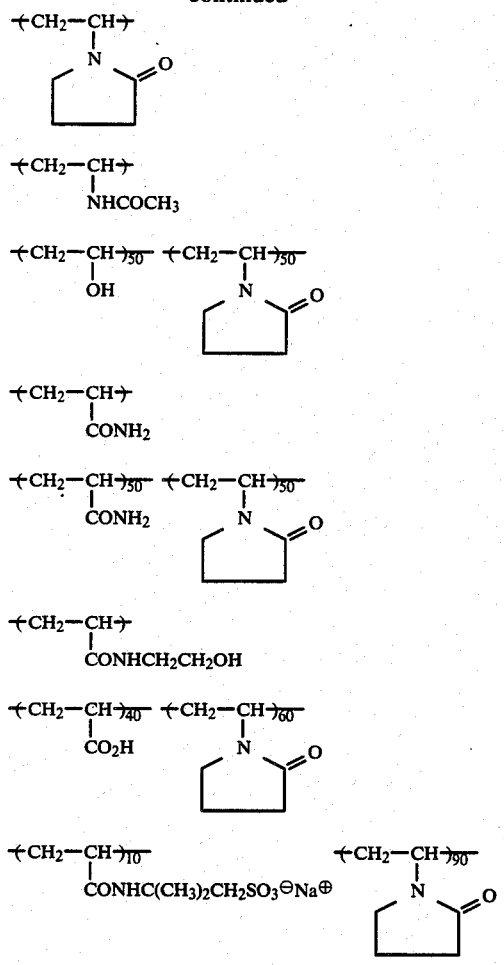

These non-cross-linked hydrophilic polymers may be used alone or in a combination of two or more of them.

In particular, dextran, gum arabic, polyethylene glycol, homo- or copolymers comprising vinyl monomers having a lactam group in the side chain thereof (e.g., homo- or copolymers of vinylpyrrolidone) and homo- or copolymers of vinyl alcohol are especially preferred non-cross-linked polymers.

The average molecular weight of the hydrophilic polymers used in the present invention is not particularly critical, but in view of the coating aptitude and the film strength, the average molecular weight is preferably as follows. Regarding the hydrophilic polymers which are incorporated in the coated layer in a cross-linked state, the average molecular weight thereof before being reacted with a cross-linking agent is preferably about 2,000 to about 500,000. Regarding the non-cross-linked hydrophilic polymers which are incorporated in the coated layer the average molecular weight thereof is preferably about 1,000 to about 500,000.

The amount of the non-cross-linked hydrophilic polymer incorporated in the coated layer according to the present invention is preferably about 1 to 10 g/m$^2$, more preferably about 0.5 to 5 g/m$^2$; and the amount of non-cross-linked polymer is about 5 wt% to 70 wt%, preferably about 10 wt% to 50 wt%, on the basis of the weight of all polymers contained in the layer in which the hydrophilic non-cross-linked polymer is incorporated. When the hydrophilic non-cross-linked polymer is incorporated in a polymer mordant-containing layer, "all polymers" upon which the weight calculation is based include the mordant, the hydrophilic non-cross-linked polymer and the hydrophilic cross-linked polymer according to the invention. A sufficient result may be attained in the present invention by using an amount of the hydrophilic non-cross-linked polymer in this range with respect to both the photographic characteristics of the present invention and the strength of the coated layer.

For the formation of binder-containing layer of the dye fixing material according to the present invention, a hydrophilic polymer which is to be incorporated in the layer in the form of a cross-linked state is selected, a cross-linking agent suitably used for this hydrophilic polymer is determined, and another hydrophilic polymer which is not cross-linked by the cross-linking agent is selected. The two kinds of hydrophilic polymers selected are blended to obtain a mixed aqueous solution, which is coated on a support together with the above cross-linking agent.

The hydrophilic polymers are not necessarily dissolved in water, but may be used in the form of a latex dispersed in water. The cross-linking agent may be added directly to the coating solution, or alternatively may be added to a coating solution for an adjacent layer. In the latter case, the two coating solutions are coated on a support to form layers superposed on each other, and the cross-linking agent contained in the adjacent layer solution is diffused into the hydrophilic polymer-containing layer during the coating step.

The amount of the cross-linking agent used is, in general, about 0.05 to 10 mols, preferably about 0.1 to 2 mols, per mol of the cross-linking moiety contained in the hydrophilic polymer to be cross-linked. For example, when the hydrophilic polymer is gelatin, the cross-linking agent to be used therefor is about 0.1 to 20 wt%, preferably about 0.5 to 5 wt%, on the basis of the gelatin used.

Preferred embodiments of layer structures of the dye fixing material of the present invention are illustrated as follows, although the present invention is not to be construed as being limited thereto. The layer marked with an asterisk (*) contains the cross-linked hydrophilic polymer and the non-cross-linked hydrophilic polymer required according to the present invention.

(1) Support-Subbing layer*-Dye fixing layer
(2) Support-Subbing layer-Hygroscopic layer*-Dye fixing layer
(3) Support-Subbing layer-Dye fixing layer*
(4) Support-Subbing layer*-Dye fixing layer*
(5) Support-Subbing layer-Dye fixing layer-Protective layer*
(6) Support-Subbing layer-Dye fixing layer*-Protective layer
(7) Support-Subbing layer-Dye fixing layer*-Protective layer*
(8) Support-Subbing layer*-Dye fixing layer*-Protective Layer*

In the above embodiments (1) through (8), a curl preventive layer may optionally be provided on the support on the opposite surface to the dye fixing layer. In addition, each of said layers, such as the dye fixing layer, may be coated on the support divided into two or more layers.

One or more layers, among the above described layers, may additionally contain a base and/or a base precursor for the purpose of accelerating the transference of a dye, a hydrophilic thermal solvent, a color mix preventive agent for the purpose of preventing any color mix, a UV absorbent, a vinyl compound dispersion for the purpose of improving dimensional stability, a brightening agent, etc.

In the above described layer embodiments, the binders incorporated in the layer(s) other than those containing the combination of the hydrophilic polymers of the present invention are preferably hydrophilic binders, and transparent or semi-transparent hydrophilic colloids are typically used, for example, including natural substances such as proteins, e.g., gelatin, gelatin derivatives, polyvinyl aclohol and cellulose derivatives, and polysaccharides, e.g., starches and gum arabic; and synthetic polymer substances such as water-soluble polyvinyl compounds, e.g., dextrin, pullulan, polyvinyl alcohol, polyvinyl pyrrolidone and acrylamide polymer. In particular, gelatin and polyvinyl alcohol are preferred among them.

The mordant to be incorporated in the dye fixing material of the present invention is preferably a polymer which contains a vinyl monomer unit having a tertiary amino group or a quaternary ammonium group, as represented by the following formulae (X) to (XIII):

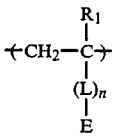

(X)

wherein $R_1$ is a hydrogen atom or a lower alkyl group having about 1 to 6 carbon atoms; L represents a divalent linking group having about 1 to 20 carbon atoms; E represents a hetero ring containing a carbon-nitrogen double bond; and n is 0 or 1.

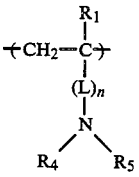

(XI)

wherein $R_1$, L and n have the same meaning as in the above formula (X); $R_4$ and $R_5$ are the same or different and each represents an alkyl group having about 1 to 12 carbon atoms or an aralkyl group having about 7 to 20 carbon atoms, and $R_4$ and $R_5$ may form, together with the adjacent nitrogen atom, a cyclic structure.

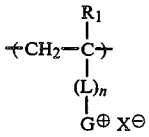

(XII)

wherein $R_1$, L and n have the same meaning as in the above formula (X); $G^{\oplus}$ represents a hetero ring which is quaternized and contains a carbon-nitrogen double bond; and $X^{\ominus}$ represents a monovalent anion.

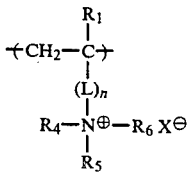

(XIII)

wherein $R_1$, L and n have the same meaning as in the above formula (X); $R_4$ and $R_5$ have the same meaning as in the above formula (XI); $R_6$ has the same definition as $R_4$ and $R_5$; $X^{\ominus}$ has the same meaning as in the above formula (XII); and $R_4$ and $R_5$, $R_5$ and $R_6$, or $R_4$ and $R_6$ may form, together with the adjacent nitrogen atom, a cyclic structure.

In the above formulae (X) to (XIII), $R_1$ preferably represents a hydrogen atom or a lower alkyl group having about 1 to 6 carbon atoms, for example, a methyl group, an ethyl group, an n-propyl group, an n-butyl group, an n-amyl group or an n-hexyl group; and $R_1$ is especially preferably a hydrogen atom or a methyl group.

L preferably represents a divalent linking group having 1 to about 20 carbon atoms, for example, an alkylene group (such as a methylene group, an ethylene group, a trimethylene group or a hexamethylene group), a phenylene group (such as an o-phenylene group, a p-phenylene group or an m-phenylene group), an arylenealkylene group (such as

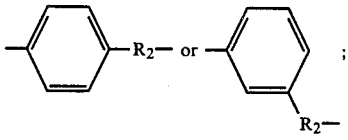

in which $R_2$ represents an alkylene group having 1 to about 12 carbon atoms), $—CO_2—$, $—CO_2—R_3—$ (in which $R_3$ represents an alkylene group, a phenylene group or an arylenealkylene group), $—CONH—R_3—$ (in which $R_3$ has the same meaning as above),

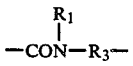

(in which $R_1$ and $R_3$ have the same meaning as above); and L is especially preferably

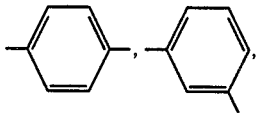

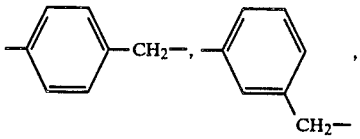

$—CO_2—$, $—CONH—$, $—CO_2—CH_2CH_2—$, $—CO_2—CH_2CH_2CH_2—$, $—CONHCH_2—$, $—CONHCH_2CH_2—$ or $—CONHCH_2CH_2CH_2—$.

In the formula (X), E preferably represents a hetero ring containing a carbon-nitrogen double bond, for example, an imidazole ring (such as

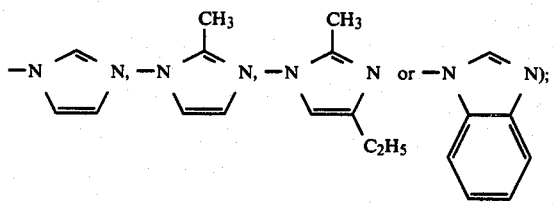

a triazole ring (such as

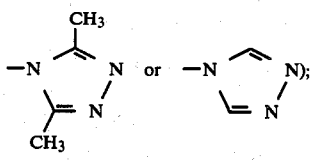

a pyrazole ring (such as

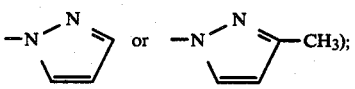

a pyridine ring (such as

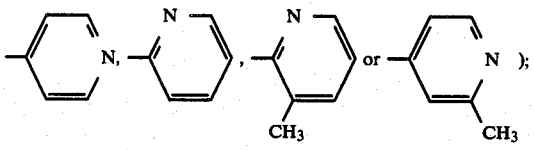

a pyrimidine ring (such as

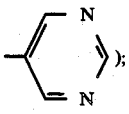

and E is especially preferably an imidazole ring or a pryidine ring.

Preferred examples of the polymers of the formula (X), which contain a vinyl monomer unit having a tertiary amino group, are mordants as described in U.S. Pat. Nos. 4,282,305, 4,115,124 and 3,148,061; and some typical examples thereof are described below, although the present invention is not to be construed as being limited thereto:

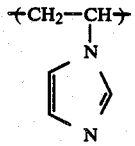

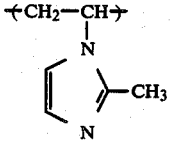

-continued

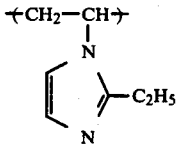

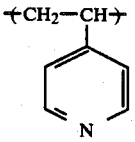

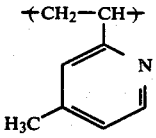

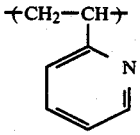

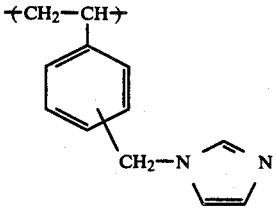

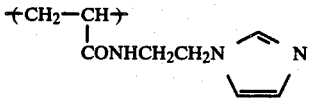

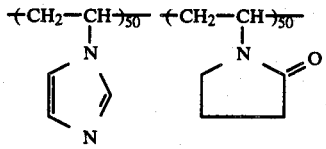

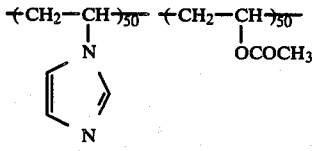

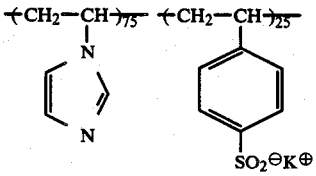

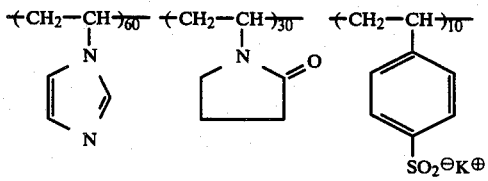

-continued

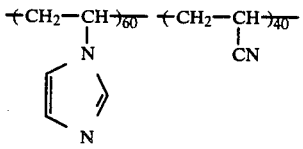

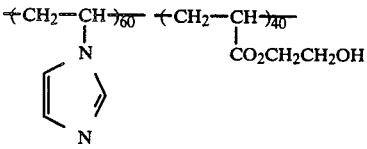

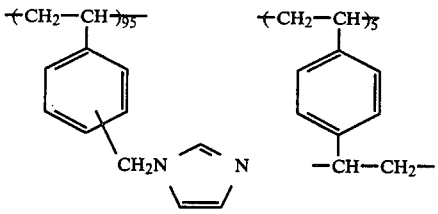

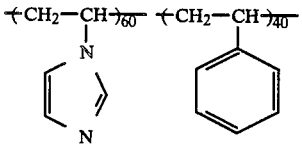

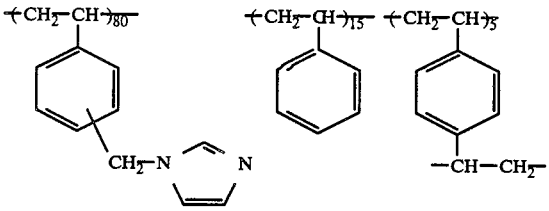

-continued (number: mol %)

In the formula (XI), $R_4$ and $R_5$ each preferably represents an alkyl group having about 1 to 12 carbon atoms, such as an unsubstituted alkyl group (e.g., a methyl group, an ethyl group, an n-propyl group, an n-butyl group, an n-amyl group, a hexyl group, an n-nonyl group, an n-decyl group or an n-dodecyl group) or a substituted alkyl group (e.g., a methoxyethyl group, a 3-cyanopropyl group, an ethoxycarbonylethyl group, an acetoxyethyl group, a hydroxyethyl group or a 2-butenyl group), or an aralkyl group having about 7 to 20 carbon atoms, such as an unsubstituted aralkyl group (e.g., a benzyl group, a phenethyl group, a diphenylmethyl group or a naphthylmethyl group) or a substituted aralkyl group (e.g., a 4-methylbenzyl group, a 4-isopropylbenzyl group, a 4-methoxybenzyl group, a 4-(4-methoxyphenyl)benzyl group or a 3-chlorobenzyl group).

In formula (XI), $R_4$ and $R_5$ may form, together with the adjacent nitrogen atom, a cyclic structure, and examples of such cyclic structures are

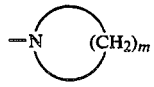

(in which m is an integer of 4 to 12) or

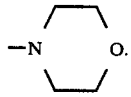

Preferred examples of the polymers of the formula (XI), which contain a vinyl monomer unit having a tertiary amino group, include the following:

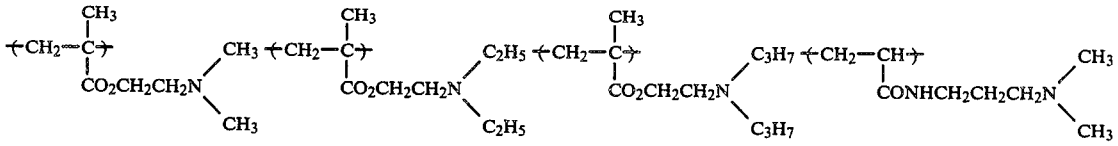

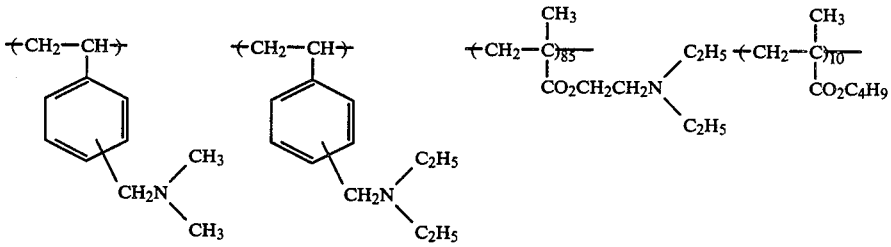

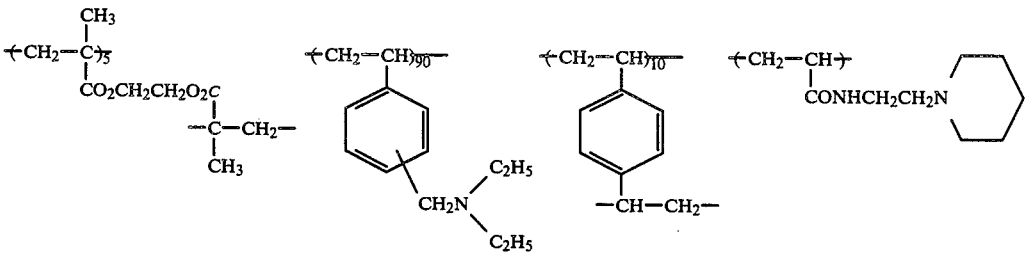

-continued

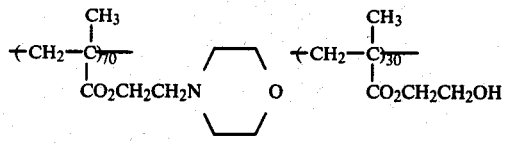

(number: mol %)

In the formula (XII), G⊕ preferably represents a hetero ring which is quaternized an contains a carbon-nitrogen double bond, and typical examples thereof include an imidazolium salt (e.g.,

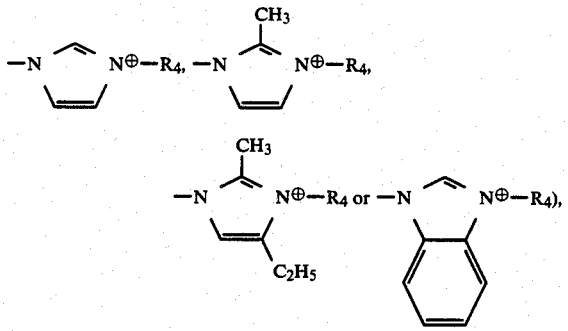

a triazolium salt (e.g.,

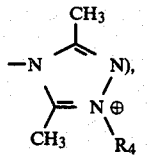

a pyridinium salt (e.g.,

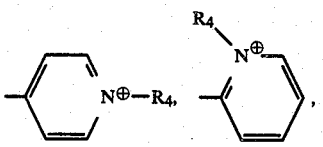

-continued

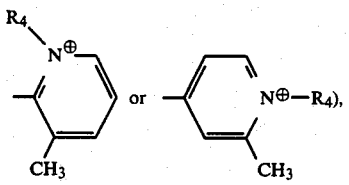

and imidazolium salts and pyridinium salts are especially preferred among them. In the above formulae, $R_4$ has the same meaning as in the formula (XI), and is especially preferably a methyl group, an ethyl group or a benzyl group.

In the formulae (XII) and (XIII), X⊖ represents an anion, for example, a halogen ion (e.g., a chlorine ion, a bromine ion or an iodine ion), an alkylsulfate ion (e.g., a methylsulfate ion, or an ethylsulfate ion), an alkyl- or arylsulfonate ion (e.g., a methanesulfonate ion, an ethanesulfonate ion, a benzenesulfonate ion or a p-toluenesulfonate ion), an acetate ion or a sulfate ion, and is especially preferably a chlorine ion or a p-toluenesulfonate ion.

Preferred examples of the polymers of the formula (XII), which contain a vinyl monomer unit having a quaternary ammonium group, are mordants as described in British Pat. Nos. 2,056,101, 2,093,041 and 1,594,961, U.S. Pat. Nos. 4,124,386, 4,115,124, 4,273,853 and 4,450,224 and Japanese Patent Application (OPI) No. 28225/73. Typical examples thereof are described below, although the present invention is not to be construed as being limited thereto.

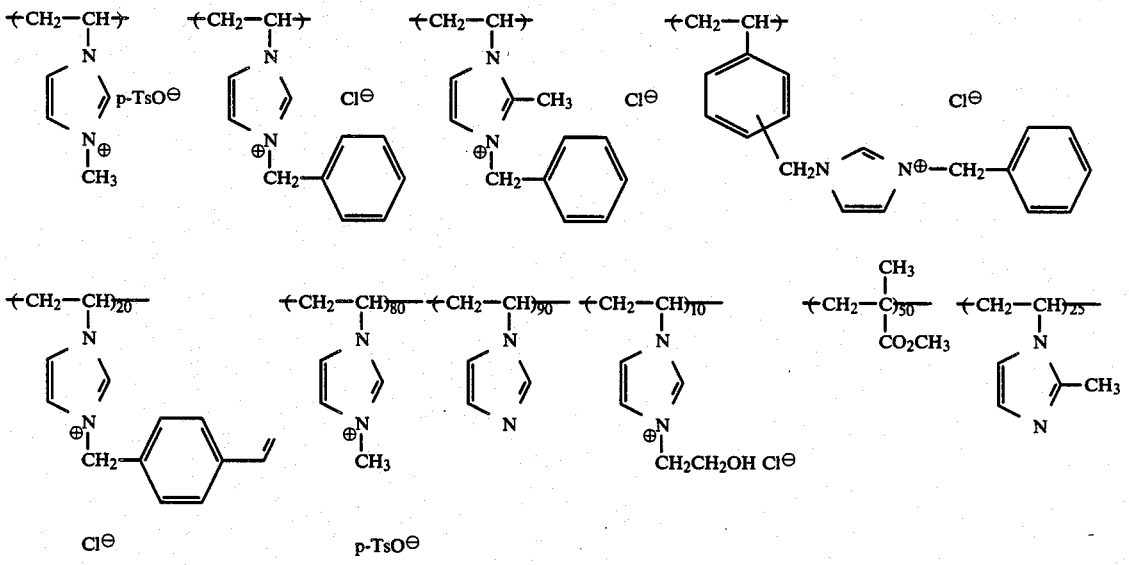

-continued

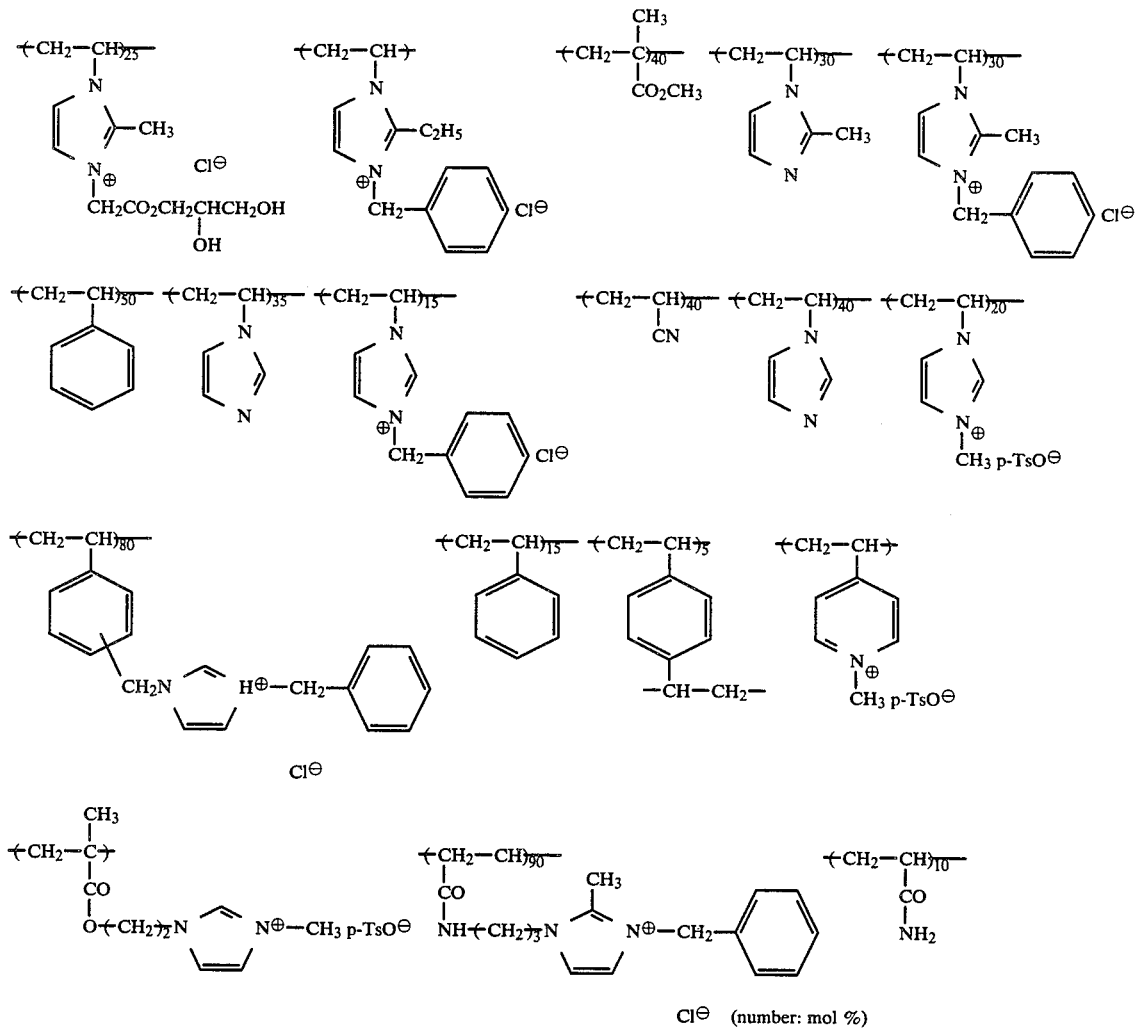

In the above formulae, p-TsO⊖ is

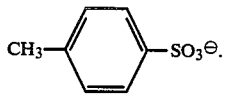

In the formula (XIII), $R_4$ and $R_5$ may form, together with the adjacent nitrogen atom, a cyclic structure, for example,

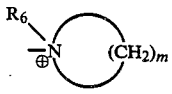

(in which m is an integer of 4 to 12) or

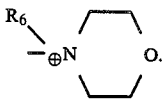

In addition, $R_4$, $R_5$ and $R_6$ may also form, together with the adjacent nitrogen atom, a cyclic structure, for example,

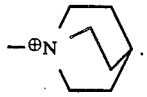

Preferred examples of the polymers of the formula (XIII), which contain a vinyl monomer unit having a quaternary ammonium group, are mordants as described in U.S. Pat. Nos. 3,709,690, 3,898,088 and 3,958,995, and some typical examples thereof are described below, although the present invention is not to be construed as being limited therto:

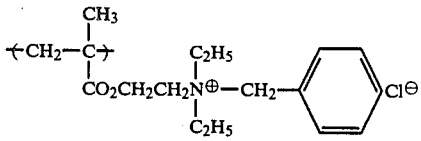

-continued

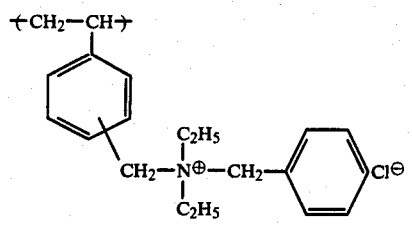

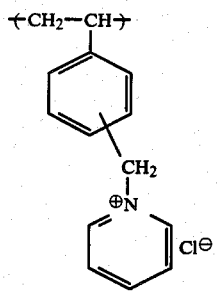

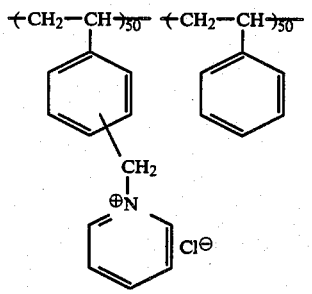

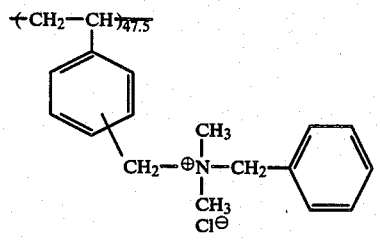

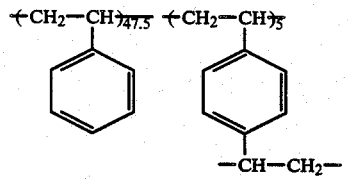

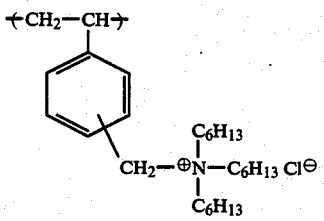

-continued

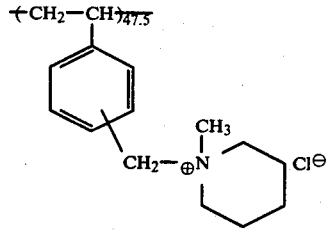

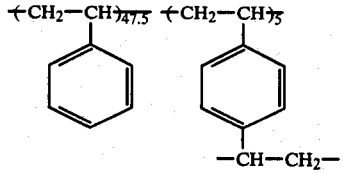

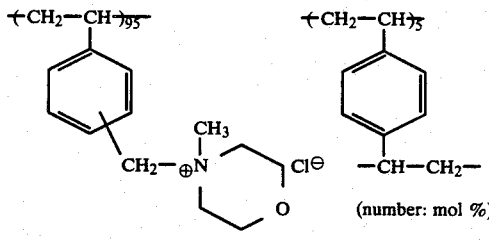

(number: mol %)

In addition to the above described mordants, various other mordants may be used in the present invention, for example, vinylpyridine polymers and vinylpyridinium cation polymers as illustrated in U.S. Pat. Nos. 2,548,564, 2,484,430, 3,148,061 and 3,756,814; polymer mordants which are cross-linkable with gelatin or the like, as described in U.S. Pat. Nos. 3,625,694, 3,859,096 and 4,128,538 and British Pat. No. 1,277,453; aqueous sol type mordants as illustrated in U.S. Pat. Nos. 3,958,995, 2,721,852 and 2,798,063 and Japanese Patent Application (OPI) Nos. 115228/79, 145529/79 and 126027/79; water-insoluble mordants as illustrated in U.S. Pat. No. 3,898,088; reactive mordants which may be bound with a dye by means of a covalent bond, as illustrated in U.S. Pat. No. 4,168,976 (corresponding to Japanese Patent Application (OPI) No. 137333/79); mordants as illustrated in U.S. Pat. Nos. 3,709,690, 3,788,855, 3,642,482, 3,488,706, 3,557,066, 3,271,147 and 3,271,148 and Japanese Patent Application (OPI) Nos. 71332/75, 30328/78, 155528/77, 125/78 and 1024/78.

Furthermore, mordants as described in U.S. Pat. Nos. 2,675,316 and 2,882,156 may also be used in the present invention.

The mixture ratio of polymer mordant to gelatin and the amount of the polymer mordant to be coated may easily be determined by those skilled in the art, in accordance with the amount of a dye to be mordanted, the kind and the constitution of the polymer mordant used and the procedure for image formation, and in general, the ratio of mordant/gelatin is preferably about 20/80 to 80/20 (by weight), and the amount of the mordant to be coated is preferably about 0.2 to 15 g/m$^2$, more preferably about 0.5 g to 8 g/m$^2$. The molecular weight of the polymer mordant used in the present invention is preferably about 1,000 to 1,000,000, more preferably about 10,000 to 200,000.

The density of a dye image formed may be increased by combination use of a polymer mordant and a metal ion. The metal ion is added to a dye fixing layer containing a mordant, or to upper and/or lower layer(s) which are adjacent to the dye fixing layer. The metal ion to be used therefor is preferably colorless and stable to heat and light. In particular, polyvalent ions of transition metals such as $Cu^{2+}$, $Zn^{2+}$, $Ni^{2+}$, $Pt^{2+}$, $Pd^{2+}$ and $Co^{2+}$ ions are preferred, and $Zn^{2+}$ is especially preferred among them. The metal ion is added to the above described layer(s), in general, in the form of a water-soluble compound such as $ZnSO_4$ or $Zn(CH_3CO_2)_2$, and the amount of the compound to be added is generally about 0.01 to 5 g/m$^2$, preferably about 0.1 to 1.5 g/m$^2$.

In the present invention, the amount of water applied to a dye fixing material in the process of the invention for transfer of a diffusible dye to the material is not more than the amount needed to maximally swell the layer coated on the dye fixing material, or in other words, the amount of water applied is restricted to an amount equal to the weight of water corresponding to the maximum swollen volume of the layer coated on the dye fixing material minus the weight of the coated layer or less when the measurement of the maximum swollen volume of the coated layer is carried out in accordance with the method described in *Photographic Science Engineering,* Vol. 16, p. 449 (1972).

When the amount of the applied water is greater than the above defined range, exceeding the scope of the present invention, the transferred color image often bleeds out, which is undesirable.

On the other hand, the minimum amount of the water used for dye transfer is sufficient to permit the diffusible dye to be fully transferred to the dye fixing material. In general, the amount of the water applied is preferably at least about 10% of the total weight of the coated layers (in a dry state) of both the diffusible dye-containing material and the dye fixing material to allow the released dye to be completely transferred to the dye fixing material. In particular, it is especially preferred to apply water to the dye fixing material in an amount which is at least about equal to the volume of the dry coated layer of the diffusible dye-containing material to obtain a preferable result on the transfer speed in the present invention.

The "amount of water applied" as used herein means the amount of water applied to a dye fixing material which is present at the time when the diffusible dye-containing material and the dye fixing material are contacted with each other to transfer the diffusible dye to the dye fixing material. Accordingly, an amount of water falling within the scope of the present invention as defined above can be measured and this amount of water may be applied to the dye fixing material; or alternatively, a sufficient amount (or an excess amount) of water can first be applied to the dye fixing material and thereafter the excess can be removed by pressing the material with rollers in order to squeeze out the excess water, or can be heated so as to dry the material, whereby the amount of the applied water is regulated to fall within the scope of the present invention as defined above.

For the application of water to the dye fixing material, various means may be utilized; for example, a roller coating method or a wire bar coating method, as described in Japanese Patent Application No. 55907/83 (corresponding to Japanese Patent Application (OPI) No. 181353/84); a method where water is coated on the surface of a dye fixing material by the use of a water absorptive material as described in Japanese Patent Application No. 55908/83 (corresponding to Japanese Patent Application (OPI) No. 181354/84); a method where beads are formed between a water repellent roller and a dye fixing material thereby to apply water to the dye fixing material as described in Japanese Patent Application No. 55910/83 (corresponding to Japanese Patent Application (OPI) No. 181348/84); and other methods including a dip method, an extrusion method, a jetting method in which water is jetted out from small orifices, a method in which water-containing pods are crushed, or other conventional methods of applying the water may be utilized in the present invention. After the necessary amount of water is applied to the dye fixing material as described above, any excess water which is not absorbed into the coated layer of the dye fixing material but remains on the surface of this layer is preferably removed by any conventional method such as squeezing the excess amount of the applied water by the use of rollers or the like under pressure or by blowing off or drying up the water under heat or with a hot air, as described above, whereby a transferred image of high quality with reduced color bleeding may be obtained.

The "water" to be used in the present invention includes not only pure water but also any and every conventional "water" which may widely and generally be used in various fields.

Accordingly, the water to be used in the present invention includes general drinking water, industrial water, etc. As for the general drinking water, the quality standard for city water as determined by the authority of U.S.A. or the quality standard for water as determined by the World Health Organization (WHO) is applied to said drinking water, and any water satisfying such standards may be used in the present invention. In addition, industrial water may also be used in the present invention, which is in general used in various industrial fields. The standard on the quality of industrial water is described, e.g., in *Hygienic Technology Handbook,* p. 356 (Asakura Shoten Publishing Co., Japan, 1967). Any and every industrial water which satisfies this standard on the quality of industrial water may be used in the present invention, including ground water, river water, or water containing chemicals (such as NaOH- or KOH-containing water).

According to the process of the present invention, the surface of the dye fixing layer of the dye fixing material to which water has been applied as described above is superposed and contacted with the surface of the diffusible dye-containing layer of a photographic material in which a diffusible dye is imagewise formed or released by heat development or the like photographic treatment and then heated, whereby the diffusible dye is transferred from the latter photographic material to the former dye fixing material.

Various conventional heating means may be applied to the transferring step of the present invention; for example, heating the superposed materials by passing them through hot plates or by contacting them with hot plates (e.g., as described in Japanese Patent Application (OPI) No. 62635/75); heating the superposed materials by contacting them with hot drums or hot rollers, while rotating (e.g., as described in Japanese Patent Publication No. 10791/68); heating the superposed materials by passing them through a hot air (e.g., as described in Japanese Patent Application (OPI) No. 32737/78); heating the superposed materials by passing them through an inert liquid kept at a determined temperature; heating the superposed materials by leading them along a heat source by the use of guide rollers, conveyor belt or the like guide means (e.g., as described in Japanese Patent Publication No. 2546/69). Apart from these heating methods, the dye fixing material may directly be heated by providing an electroconductive material layer containing graphite, carbon black or a metal substance on the dye fixing element layer, and applying an electric current to the electroconductive layer thereby to heat the dye fixing element layer.

The heating temperature in the transferring step according to the invention, when a heat developable photographic material is used, is within the range from the temperature in the heat development step to room temperature, and is preferably within the range of from 60° C. to a temperature lower than the heat development temperature by at least 10° C.

The pressure used to adhere the diffusible dye-containing material and the dye fixing material varies depending upon various conditions and kinds of materials used, and is preferably about 0.1 to 100 kg/cm$^2$, more preferably about 1 to 50 kg/cm$^2$, for example, as described in Japanese Patent Application No. 55691/83 (corresponding to Japanese Patent Application (OPI) NO. 180547/84).

Various means may be utilized for applying pressure to the two materials. For example, the two materials can be introduced between a pair of rollers, or pressed with sufficiently even plates. The temperature of the rollers or plates used for pressing the two materials may freely be chosen within the range from room temperature to the temperature in the heat development step.

In the present invention, any conventional dye-transferring assistant other than water may be used, in addition to water. Such dye-transferring assistants may be applied to the dye fixing material of the present invention from the outside. For example, a basic aqueous solution containing an inorganic alkali metal salt, such as sodium or potassium hydroxide, or a solvent having a low boiling point, such as methanol, N,N-dimethylformamide, acetone or diisobutyl ketone, may be used as a dye-transferring assistant. In order to apply a dye-transferring assistant to the dye fixing material of the present invention, the material may be wetted with the assistant agent.

When a dye-transferring assistant is previously incorporated in the photographic material and/or dye fixing material, it is of course unnecessary subsequently to add any further dye-transferring assistant other than water to the dye fixing material. For example, it is preferred to incorporate a hydrophilic thermal solvent which is solid at normal temperature but may melt at a high temperature in the diffusible dye-containing material or in the dye fixing material. The hydrophilic thermal solvent may be incorporated in either of the diffusible dye-containing material and the dye fixing material, or may be incorporated in both of these materials. When the hydrophilic thermal solvent is incorporated in the material(s), it may be incorporated in any of an emulsion layer, an intermediate layer, a protective layer and a dye fixing layer, and in particular, the solvent is preferably incorporated in the dye fixing layer and/or the adjacent layer(s).

Examples of hydrophilic thermal solvents include ureas, pyridines, amides, sulfonamides, imides, alcohols, oximes and other heterocyclic compounds.

A diffusible dye-containing material which is prepared as mentioned below is preferably used in the process of the present invention. A heat developable color photographic material at least comprising a photographic silver halide, a binder and a dye providing substance capable of forming or releasing a diffusible dye when the photographic silver halide is reduced to silver by heat development in correspondence or counter-correspondence with the reduction reaction is provided on a support, is imagewise exposed and thereafter is heated in a substantially water-free state thereby to imagewise form a diffusible dye in the material, and the thus prepared diffusible dye-containing photographic material is especially preferably used in the process of the present invention.

The silver halides used in the present invention may be any silver chloride, silver bromide, silver iodide, silver chlorobromide, silver chloroiodide, silver iodobromide and silver chloroiodobromide. These silver halide grains may either have a uniform halogen composition or have a structure with different inner and outer halogen compositions, as described in Japanese Patent Application (OPI) Nos. 154232/82, 108533/83, 48755/84 and 52237/84, U.S. Pat. No. 4,433,048 and European Pat. No. 100,984. Regarding the shape of the silver halide grains, tabular grains having a thickness of about 0.5 μm or less, a diameter of at least about 0.6 μm and an average aspect ratio of about 5 or more (as described, e.g., in U.S. Pat. Nos. 4,414,310 and 4,435,499 and West German Patent Application (OLS) No. 3,241,646 A1) may be used in the present invention. In addition, a monodisperse emulsion, containing silver halide grains of nearly uniform grain size distribution (as described, e.g., in Japanese Patent Application (OPI) Nos. 178235/82, 100846/83 and 14829/83, Unexamined Published International Patent Application No. 83/02338A1, and European Patents 64,412A3 and 83,377A1) may also be used in the present invention. Furthermore, two or more kinds of silver halides each having different crystal habit, halogen composition, grain size and grain size distribution may be used together; and it is also possible to blend two or more kinds of monodisperse emulsions each having different grain size thereby to suitably regulate the gradation of an image to be formed.

The average grain size of silver halide grains to be used in the present invention is preferably within the range of about 0.001 μm to 10 μm, more preferably about 0.001 μm to 5 μm. The silver halide emulsion may be prepared by any conventional means such as an acid method, a neutral method or an ammonia method. For the reaction of a soluble silver salt and a soluble halogen salt, any of a single jet method or a double jet method or a combination thereof may be used. In addition, a reverse mixing method where silver halide grains are formed in the presence of an excess of silver ion; or a controlled double jet method where the value of pAg is kept constant may also be used. In order to accelerate the growth of silver halide grains in the reaction, the concentration of the silver salt and halogen salt to be added as well as the amount thereof and the rate of addition thereof may be elevated appropriately, as disclosed in Japanese Patent Application (OPI) Nos. 142329/80 and 158124/80 and U.S. Pat. No. 3,650,757.

Silver halide grains of epitaxial over grown type may also be used in the present invention, as disclosed in Japanese Patent Application (OPI) No. 16124/81 and U.S. Pat. No. 4,094,684.

When a silver halide alone is used in the heat developable color photographic material of the present invention, i.e., without the combined use of an organic silver salt oxidizing agent, it is preferred to use silver chloroiodide, silver iodobromide and silver chloroiodobromide exhibiting an X-ray diffraction pattern of silver iodide crystals.

Such silver halides may be formed, for example, by first adding a silver nitrate solution to a potassium bromide solution to form silver bromide grains, and then adding potassium iodide thereto, to obtain silver iodobromide having this characteristic.

In the step of forming silver halide grains to be used in the present invention, a solvent for dissolving a silver halide may be used, such as ammonia or an organic thioether derivative as described in Japanese Patent Publication No. 11386/72, or a sulfur-containing compound as described in Japanese Patent Application (OPI) No. 144319/78.

During the step of formation of silver halide grains or physical ripening thereof, a cadmium salt, a zinc salt, a lead salt, a thallium salt may be used.

In addition, in order to improve any high intensity reciprocity failure or low intensity reciprocity failure, a water-soluble iridium salt such as iridium (III, IV) chloride or ammonium hexachloroiridate, or a water-soluble rhodium salt such as rhodium chloride may further be used in preparing the silver halide grains or their physical ripening.

Soluble salts, if any, may be removed from the silver halide emulsion, after the formation of silver halide precipitates or after the physical ripening thereof, by noodle washing or by a sedimentation method.

The silver halide emulsion may be used without being postripened, but in general, the emulsion is used after being chemically sensitized. An emulsion for a photographic material, in general, may be ripened by conventional sulfur sensitization, reduction sensitization or noble metal sensitization or a combination of said conventional sensitization means, which may be carried out in the presence of a nitrogen-containing heterocyclic ring compound as described, e.g., in Japanese Patent Application (OPI) Nos. 126526/83 and 215644/83.

The silver halide emulsion to be used in the present invention may be any of a surface latent image type where a latent image is formed mainly on the surface of silver halide grains, or an internal latent image type where a latent image is formed mainly in the inner part of the grains. In addition, a direct reversal emulsion comprising a combination of the internal latent image type emulsion and a nucleating agent may also be used in the present invention. Various kinds of internal latent image type emulsions which are suitable are described, e.g., in U.S. Pat. Nos. 2,592,250 and 3,761,276, Japanese Patent Publication No. 3534/83 and Japanese Patent Application (OPI) No. 136641/82. Preferred nucleating agents which may be used in the present invention in combination with the internal latent image type emulsion are described, e.g., in U.S. Pat. Nos. 3,227,552, 4,245,037, 4,255,511, 4,266,013 and 4,276,364 and West German Patent Application (OLS) No. 2,635,316.

The amount of the light-sensitive silver halide in the light-sensitive layer of the present invention is from about 1 mg/m$^2$ to 10 g/m$^2$, preferably about 50 mg/m$^2$ to 8 g/m$^2$, calculated in terms of the content of silver therein.

In the present invention, an organic metal salt which is relatively stable to light may be used as an oxidizing agent, together with the light-sensitive silver halide. In this case, it is necessary that the light-sensitive silver halide and organic metal salt be in close relation, e.g., either kept in contact with each other or kept near to each other. An organic silver salt is especially preferably used as the organic metal salts. Although not desiring to be bound by theory, when an organic silver salt is used in the heat developable photographic material according to the present invention, when the exposed photographic material is heated at a temperature of about 80° C. or higher, preferably about 100° C. or higher, the organic silver salt oxidizing agent is considered to participate in a redox reaction occurring under heat in the presence of a silver halide latent image as a catalyst.

Examples of organic compounds which may be used as the organic component of said organic silver salt oxidizing agents include aliphatic or aromatic carboxylic acids, thiocarbonyl group-containing compounds having a mercapto group or α-hydrogen and imino group-containing compounds.

Typical examples of aliphatic carboxylic acids used as the organic component include behenic acid, stearic acid, oleic acid, lauric acid, capric acid, myristic acid, palmitic acid, maleic acid, fumaric acid, tartaric acid, furoinic acid, linoleic acid, linolenic acid, oleic acid, adipic acid, sebacic acid, succinic acid, acetic acid, butyric acid or camphoric acid. In addition, silver salts of halogen-substituted or hydroxyl-substituted derivatives of these fatty acids or silver salts of thioether group-containing aliphatic carboxylic acids may also be used in the present invention.

Examples of aromatic carboxylic acids or other carboxyl-containing compounds used as the organic component of the organic silver salts include benzoic acid, 3,5-dihydroxybenzoic acid, o-, m- or p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid or 3-carboxymethyl-4-methyl-4-thiazoline-2-thione.

Examples of mercapto- or thiocarbonyl-containing organic components of the organic silver salt include 3-mercapto-4-phenyl-1,2,4-triazole, 2-mercaptobenzimidazole, 2-mercapto-5-aminothiadiazole, 2-mercaptobenzothiazole, s-alkylthioglycolic acid in which the alkyl moiety has about 12 to 22 carbon atoms, dithiocarboxylic acids such as dithioacetic acid, thioamides such as thiostearoamide, 5-carboxy-1-methyl-2-phenyl-4-thiopyridine, mercaptotriazine, 2-mercaptobenzoxazole, mercaptooxadiazole or 3-amino-5-benzylthio-1,2,4-triazole and other mercapto compounds, as described in U.S. Pat. No. 4,123,274.

Examples of imino-containing compounds which may be used as the organic component include benzotriazole or derivatives thereof as described in Japanese Patent Publication Nos. 30270/69 and 18416/70, for example, benzotriazole, methylbenzotriazole and other alkyl-substituted benzotriazoles, 5-chlorobenzotriazole and other halogen-substituted benzotriazoles, and butylcarboimidobenzotriazole and other carboimidobenzotriazoles; nitrobenzotriazoles as described in Japanese Patent Application (OPI) No. 118639/83; sulfobenzotriazole, carboxybenzotriazole or salts thereof, and hydroxybenzotriazole as described in Japanese Patent Application (OPI) No. 118638/83; and 1,2,4-triazole, 1H-tetrazole, carbazole, saccharin, imidazole and derivatives thereof as described in U.S. Pat. No. 4,220,709.

In addition, silver salts as described in *Research Disclosure* RD 17029 (June, 1978), organic metal salts other than silver salts such as copper stearate, and silver salts of alkyl-containing carboxylic acids such as phenylpropiolic acid as described in Japanese Patent Application (OPI) No. 113235/85 may also be used in the present invention.

The amount of organic silver salt used in the photographic material of the present invention is about 0.01 to 10 mols, preferably about 0.01 to 1 mol, per mol of light-sensitive silver halide used. The total amount of the light-sensitive silver halide and organic silver salt is suitably from about 50 mg/m$^2$ to 10 g/m$^2$.

Examples of compositions which have the same functions as those of the above mentioned organic silver salts include light-insensitive silver halides which adsorb compounds capable of forming silver salt slightly soluble in water such as mercaptotetrazoles, mercaptobenzimidazoles or benzotriazoles.

The silver halide to be used in the present invention may be spectrally sensitized with a methine dye or other sensitizing dye. Sensitizing dyes which may be used for spectral sensitization include cyanine dyes, merocyanine dyes, complex cyanine dyes, complex merocyanine dyes, holopolar cyanine dyes, hemicyanine dyes, styryl dyes and hemioxonol dyes. Especially preferred dyes are cyanine dyes, merocyanine dyes and complex merocyanine dyes. These dyes may contain any conventional basic heterocyclic nucleus, which is typically used in conventional cyanine dyes, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, or a pyridine nucleus; these nuclei fused with an alicyclic hydrocarbon ring; and these nuclei fused with an aromatic hydrocarbon ring, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, or a quinoline nucleus. These nuclei may optionally have substituent(s) on their carbon atom(s).

The merocyanine dyes and complex merocyanine dyes may contain a ketomethylene structural nucleus, such as 5- or 6-membered heterocyclic nuclei including a pyrazolin-5-one nucleus, a thiohydantoin nucleus, a 2-thiooxazolidine-2,4-dione nucleus, a thiazolidine-2,4-dione nucleus, a rhodanine nucleus or a thiobarbituric acid nucleus.

The sensitizing dyes may be used alone or in combination of two or more sensitizing dyes. The combination use of such sensitizing dyes is often utilized for the purpose of supersensitization.

The light-sensitive emulsion of the present invention may further contain, together with the sensitizing dye, a dye which itself does not have any spectral sensitization activity but exhibits a supersensitization activity or a compound which does not itself substantially absorb visible light but exhibits a supersensitization activity. For example, the present emulsion may contain an aminostyryl compound substituted by a nitrogen-containing heterocyclic group (e.g., as described in U.S. Pat. Nos. 2,933,390 and 3,635,721), an aromatic organic acid/formaldehyde condensation product (e.g., as described in U.S. Pat. No. 3,743,510), a cadmium salt or an azaindene compound. In particular, the combinations described in U.S. Pat. Nos. 3,615,613, 3,615,641, 3,617,295 and 3,635,721 are especially preferred.

In order to incorporate the sensitizing dye into the silver halide light-sensitive emulsion of the present invention, the dye may be dispersed directly in the emulsion, or alternatively, the dye may be first dissolved in a solvent such as water, methanol, ethanol, acetone or methyl cellosolve or a mixture thereof and thereafter the resultant solution added to the emulsion. In addition, the sensitizing dye may be first dissolved in a solvent which is immiscible with water such as phenoxyethanol, and the resultant solution dispersed in water or in a hydrophilic colloid, and thereafter the resultant dispersion added to the emulsion. In another method for incorporation of the sensitizing dye into the present photographic emulsion, the sensitizing dye is admixed with a lipophilic compound such as a dye providing substance, and the sensitizing dye is incorporated into the emulsion together with the dye providing substance. When the sensitizing dye is dissolved, another sensitizing dye used in combination may be dissolved separately in a separate solvent, or alternatively, the mixture of sensitizing dyes to be used together may be dissolved in the same solvent. When the sensitizing dye is added to an emulsion, two or more sensitizing dyes may be added simultaneously in the form of a mixture thereof, each sensitizing dye may be added separately, or each sensitizing dye may be added together with any other additives. Regarding the point in time when the sensitizing dye is added to the emulsion, the dye may be added during chemical ripening or before or after chemical ripening. Alternatively, the dye may be added to the emulsion before or after the formation of silver halide grain nuclei, as disclosed in U.S. Pat. Nos. 4,183,756 or 4,225,666.

The amount of the sensitizing dye added to the emulsion is, in general, about $10^{-8}$ to $10^{-2}$ mol per mol of silver halide.

Dye providing substances useful in the present invention are explained in greater detail as follows.

One dye providing substance which may be used in the present invention is a coupler which can react with a developing agent. In this system, an oxidized developing agent formed by the oxidation reduction reaction of a silver salt and a developing agent is reacted with a coupler, thereby to form a dye, which is well known in the art. Examples of developing agents and couplers are described in detail, e.g., in T. H. James, *The Theory of the Photographic Process*, pp. 291–334 and 354–361 (4th Ed., 1977); and Shinichi Kikuchi, *Photographic Chemistry*, pp. 284–295 (4th Ed., Kyoritsu Publishing Co.).

Another useful dye providing substance is a silver dye compound comprising a combination of an organic silver salt and a dye. Examples of silver dye compounds are described in *Research Disclosure* (May, 1978) (RD-16966), pp. 54–58.

Still another useful dye providing substance is an azo dye which is used in a silver dye bleaching method for heat development.

Examples of such azo dyes and the bleaching process are described in U.S. Pat. No. 4,235,957 and *Research Disclosure* (April, 1976) (RD-14433), pp. 30–32.

Still another useful dye providing substance is a leuco dye described in U.S. Pat. Nos. 3,985,565 and 4,022,617.

A further dye providing substance useful in the present invention is a compound capable of imagewise releasing and diffusing a diffusible dye.

Such compounds may be represented by the general formula (LI):

$$(\text{Dye}—X)_n—Y \qquad \text{(LI)}$$

wherein Dye represents a dye residue or a dye precursor residue; X represents a single bond or a linking group; Y represents a group capable of providing a difference in diffusibility of the compound of formula $(Dye—X)_x—Y$, corresponding to or reversely corresponding to a latent image formed by a photographic silver salt, or alternatively represents a group capable of releasing Dye and providing a difference in diffusibility between the released Dye and the compound of formula $(Dye—X)_n—Y$; n is an integer of 1 or 2; and when n is 2, the two (Dye—X) moieties may be the same of different.

Various examples of dye providing substances of the formula (LI) are known. For instance, U.S. Pat. Nos. 3,134,764, 3,362,819, 3,597,200, 3,544,545 and 3,482,972 describe color developers comprising a combination of a hydroquinone type developing agent and a dye component; Japanese Patent Application (OPI) No. 63618/76 describes substances that may release a diffusible dye by an intramolecular nucleophilic replacement reaction; and Japanese Patent Application (OPI) No. 111628/74 describes such substances that may release a diffusible dye by an intramolecular rearrangement reaction of an isoxazolone ring. In each of these methods, a diffusible dye is released or diffused in a non-developed part, but the dye is neither released nor diffused in a developed part of the material.

In addition, both development and release or diffusion of a dye simultaneously occur in these systems, and therefore it is extremely difficult to obtain an image of high S/N ratio. Under the circumstances and in order to overcome this disadvantage, another system has been proposed, where a dye releasing compound is previously converted into an oxidized form having no dye releasing ability and the oxidized compound is used together with a reducing agent or a precursor thereof, and after development the compound is reduced with the reducing agent, which has remained unoxidized, thereby to release a diffusible dye from the compound. Examples of this dye providing substance are described, for example, in Japanese Patent Application (OPI) Nos. 110827/78, 130927/79, 164342/81 and 35533/78.

Still other substances are known capable of releasing a diffusible dye in a developed part of the dye-containing material. For instance, British Pat. No. 1,330,524, Japanese Patent Publication No. 39165/73 and U.S. Pat. No. 3,443,940 describe a substance capable of releasing a diffusible dye by reaction of a coupler having a releasing group of a diffusible dye and a developing agent in an oxidized form; and U.S. Pat. No. 3,227,550 describes a substance capable of forming a diffusible dye by reaction of a coupler having a releasing group of a nondiffusible group and a developing agent in an oxidized form.

However, methods using such color developing agents have a severe problem in that the image formed is often stained due to an oxidized and decomposed product of the developing agent used. In order to overcome this problem, other dye releasing compounds which themselves have a reductivity and do not require any developing agent have been proposed.

Typical examples of such dye releasing compounds are given below together with the publications or patents illustrating them, and providing a specific definition of each symbol in the general formulae listed below.

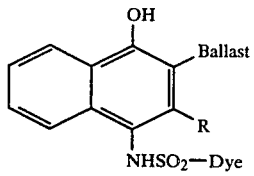

U.S. Pat. No. 3,928,312

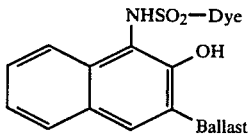

U.S. Pat. No. 4,053,312

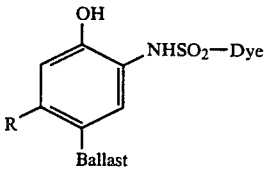

U.S. Pat. No. 4,055,428

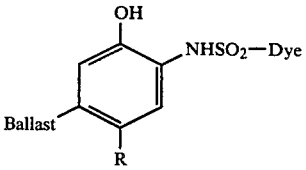

U.S. Pat. No. 4,336,322

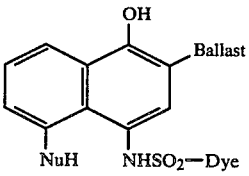

Japanese Patent Application (OPI) No. 65839/84

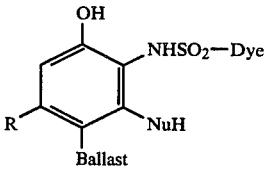

Japanese Patent Application (OPI) No. 69839/84

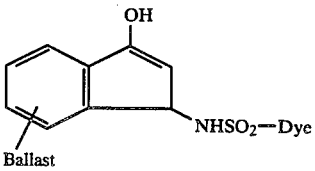

Japanese Patent Application (OPI) No. 3819/78

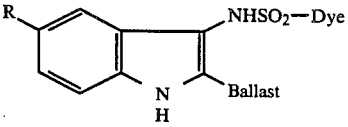

Japanese Patent Application (OPI) No. 104343/76

-continued

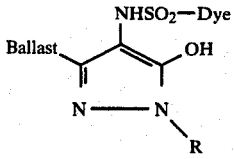

Japanese Patent Application (OPI) No. 104343/76

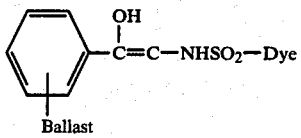

Japanese Patent Application (OPI) No. 104343/76

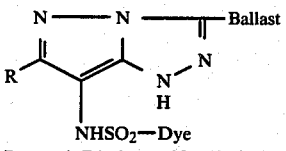

Research Disclosure No. 17465 (Oct., 1978)

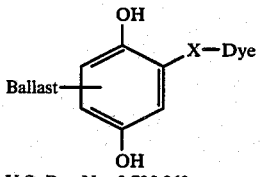

U.S. Pat. No. 3,725,062

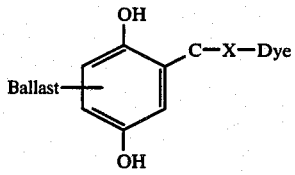

-continued

U.S. Pat. No. 3,728,113

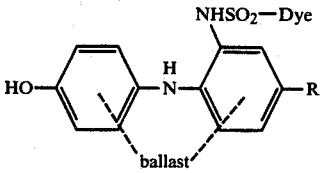

U.S. Pat. No. 3,443,939

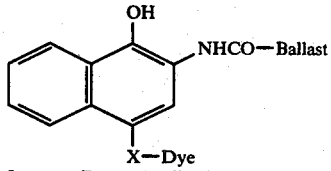

Japanese Patent Application (OPI) No. 116537/83

Among the above described various dye providing substances, those capable of forming or releasing a hydrophilic diffusible dye are especially preferred in the present invention. As used herein, the term "hydrophilic dye" means a diffusible dye having a hydrophilic group such as a carboxyl or sulfo group.

Many examples of dye providing substances which may be used in the present invention are described in the above cited patents and publications. Some preferred examples of dye providing substances of the above described formula (LI) among them are given below, which, however, are not to be construed as in any manner limiting the scope of the present invention.

LI-1

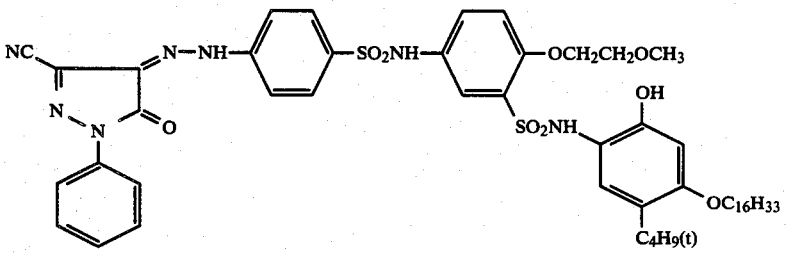

LI-2

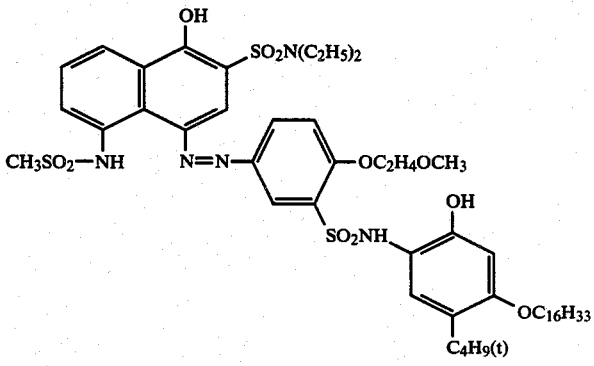

-continued
LI-3
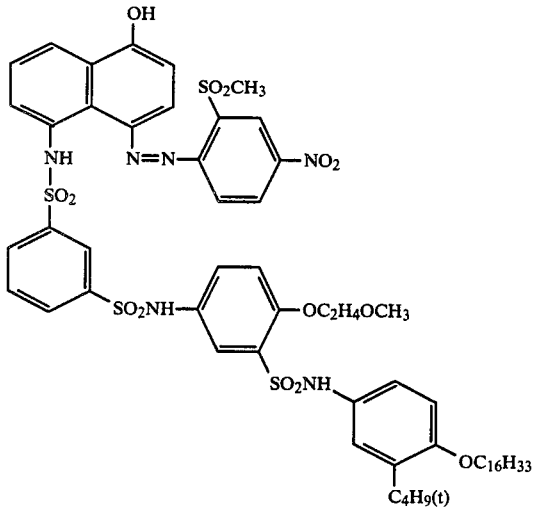
LI-4
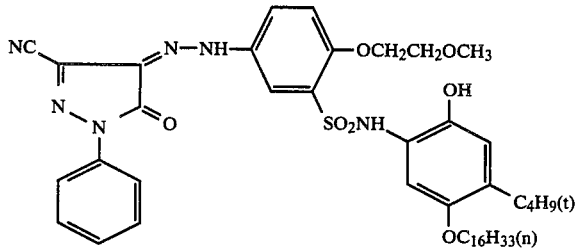
LI-5
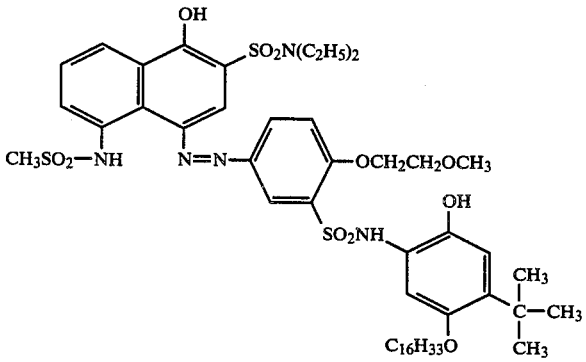
LI-6
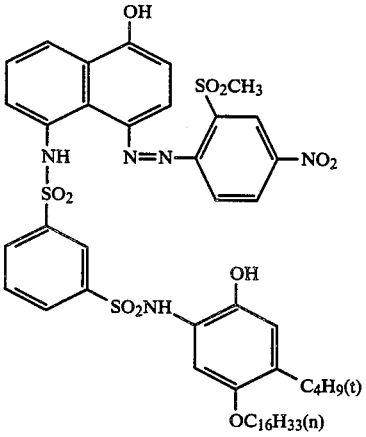

-continued
LI-7
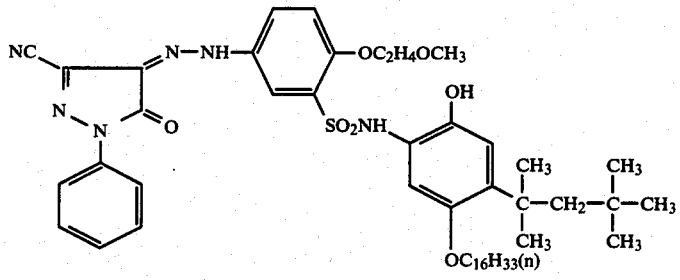
LI-8
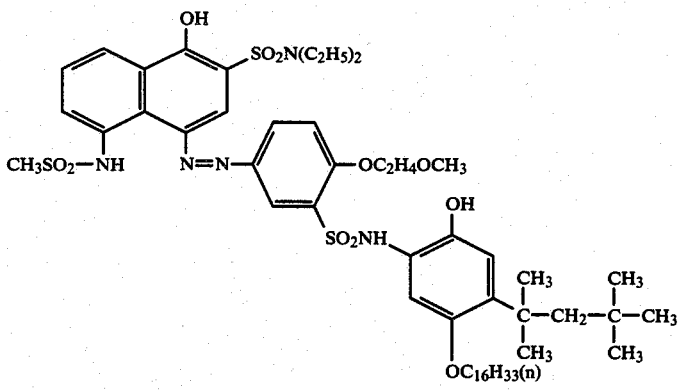
LI-9
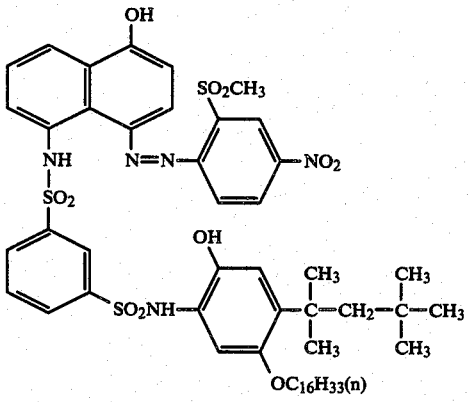
LI-10
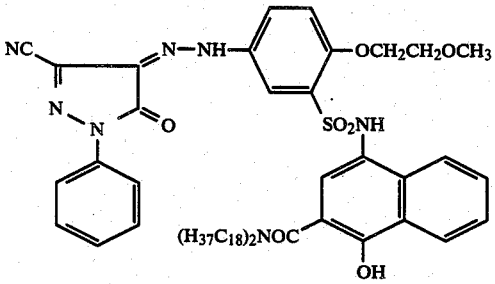

-continued
LI-11
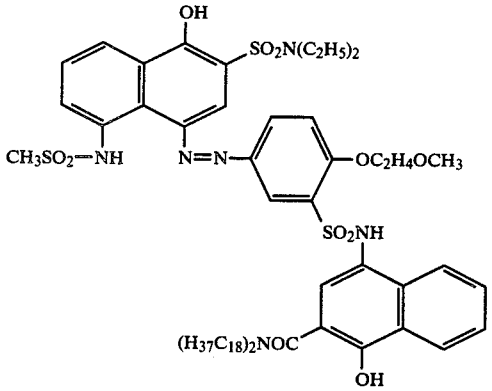
LI-12
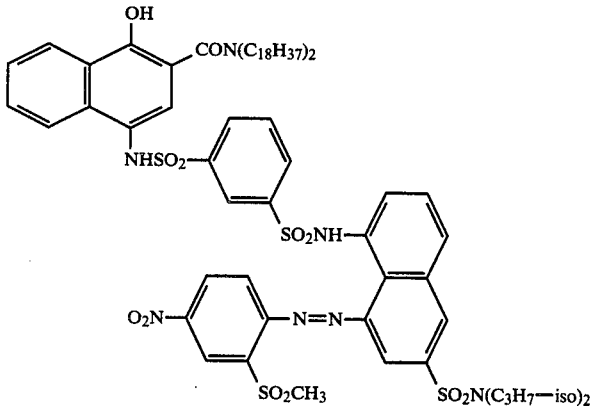
LI-13
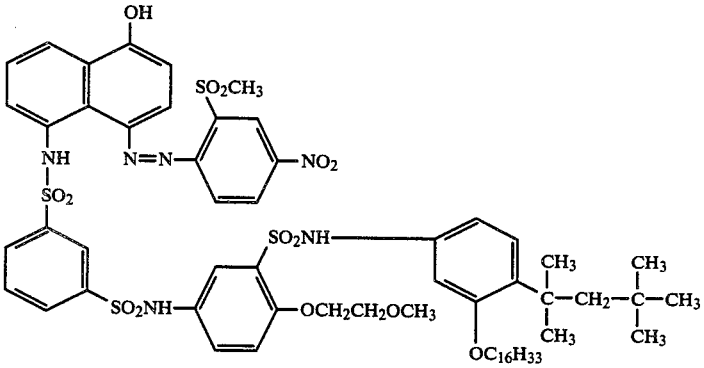
LI-14
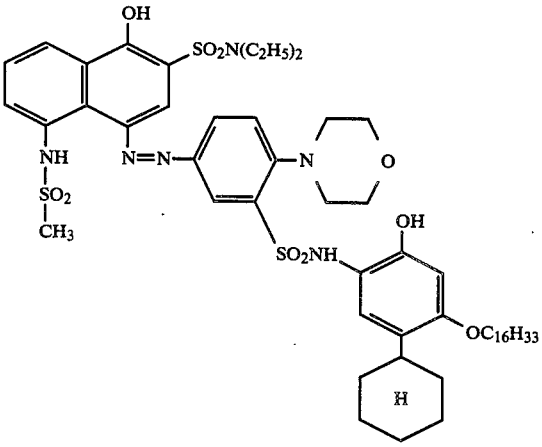

-continued

LI-15

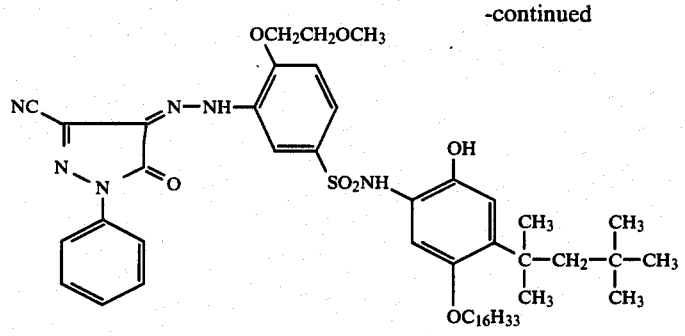

In the present invention, the dye providing substance as described above may be incorporated into layer(s) of a photographic material in a known manner, for example, according to a method described in U.S. Pat. No. 2,322,027. In this case, an organic solvent having a high boiling point or an organic solvent having a low boiling point as described hereinafter may be used.

For instance, the dye providing substance may be first dissolved in a high boiling point organic solvent such as an alkyl phthalate (e.g., dibutyl phthalate or dioctyl phthalate), a phosphate (e.g., diphenyl phosphate, triphenyl phosphate, tricresyl phosphate or dioctylbutyl phosphate), a citrate (e.g., tributyl acetyl citrate), a benzoate (e.g., octyl benzoate), an alkylamide (e.g., diethyllaurylamide, a fatty acid ester (e.g., dibutoxyethyl succinate or dioctyl azelate) or a trimesate (e.g., tributyl trimesate), or in a low boiling point organic solvent having a boiling point of about 30° C. to 160° C., such as a lower alkyl acetate (e.g., ethyl acetate or butyl acetate) or ethyl propionate, secondary butyl alcohol, methyl isobutyl ketone, β-ethoxyethyl acetate, methyl cellosolve acetate or cyclohexanone, and thereafter the resultant solution is dispersed in a hydrophilic colloid. A mixture of the high boiling point organic solvent and the low boiling point organic solvent may be used.

In addition, a dispersion method using a polymer as described in Japanese Patent Publication No. 39853/76 and Japanese Patent Application (OPI) No. 59943/76 may also be used for incorporating the dye providing substance in the photographic material of the present invention. When the dye providing substance is dispersed in a hydrophilic colloid, various surfactants may be used, and examples of such surfactants are described hereinafter in the present invention.

The amount of the high boiling point organic solvent used in the present invention is about 10 g or less, preferably about 5 g or less, per gram of the dye providing substance.

In the process of the present invention, it is preferred to incorporate a reducing substance in the photographic material. Any conventional reducing agent may be used as a reducing substance, and in addition, dye providing substances having reductivity, as described above, may also be used. Further, reducing agent precursors which themselves do not have any reductivity but may develop a reductivity by the action of a nucleophilic reagent or under heat during development procedure may also be used as reducing substances.

Examples of reducing agents which may be used in the present invention include inorganic reducing agents such as sodium sulfite, sodium hydrogensulfite, benzenesulfinic acids, hydroxylamines, hydrazines, hydrazides, borane-amine complexes, hydroquinones, aminophenols, catechols, p-phenylenediamines, 3-pyrazolidinones, hydroxytetronic acid, ascorbic acid and 4-amino-5-pyrazolones. In addition, reducing agents described in T. H. James, *The Theory of the Photographic Process*, pp. 291–234 (4th Ed., 1977) may also be utilized in the present invention. Further, reducing agent precursors described in Japanese Patent Application (OPI) Nos. 138736/81 and 40245/82 and U.S. Pat. No. 4,330,617 may also be used.

Various combinations of developing agents as illustrated in U.S. Pat. No. 3,039,869 may also be used.

In the process of the present invention, the amount of reducing agent added is about 0.01 to 20 mols, especially preferably about 0.1 to 10 mols, per mol of silver used.

In the present invention, various image formation accelerators may also be used. Image forming accelerators have various functions, for example, to accelerate the oxidation reduction reaction of a silver salt oxidizing agent and a reducing agent to accelerate the formation of a dye from a dye providing substance or the decomposition of the dye formed or the release of a diffusible dye from a dye releasing substance, or to accelerate the transfer of the dye formed from the photographic element layer to the dye fixing element layer. From the viewpoint of the physicochemical functions of such accelerators, these may be classified into bases or base precursors, nucleophilic compounds, oils, thermal solvents, surfactants and compounds having a mutual reactivity with silver or silver ion. In this connection, it is to be noted that accelerator substances in general have composite functions and thus have two or more accelerating functions as mentioned above.

Image forming accelerators useful in the present invention are grouped by function and illustrated by specific examples as follows. However, the following classification is not to be regarded as in any way critical, and in practice, many compounds often have plural functions.

(a) Bases:

Examples of preferred bases include inorganic bases of such as alkali metal or alkaline earth metal hydroxides, secondary or tertiary phosphates, borates, carbonates, quinolinates, metaborates; ammonium hydroxides; quaternary alkylammonium hydroxides; and other metal hydroxides; and organic bases such as aliphatic amines (e.g., trialkylamines, hydroxylamines, aliphatic polyamines); aromatic amines (e.g., N-alkyl-substituted aromatic amines, N-hydroxyalkyl-substituted aromatic amines and bis[p-(dialkylamino)phenyl]methanes); heterocyclic amines, amidines, cyclic amidines, guanidines and cyclic guanidines. Those having a pKa or 8 or more are especially preferred.

(b) Base Precursors:

As base precursors, those capable of releasing a base through a reaction under heat are preferably used, including a salt of an organic acid and a base capable of decarboxylating and decomposing under heat or a compound capable of decomposing and releasing an amine due to intramolecular nucleophilic replacement reaction, Lossen rearrangement, Beckmann rearrangement or the like reaction. Examples of preferred base precursors include salts of trichloroacetic acid as described in British Pat. No. 998,949; salts of α-sulfonylacetic acid as described in U.S. Pat. No. 4,060,420; salts of propiolic acids as described in Japanese Patent Application No. 55700/83 (corresponding to Japanese Patent Application (OPI) No. 180537/84); 2-carboxycarboxamide derivatives as described in U.S. Pat. No. 4,088,496; salts of pyrolytic acids, in which an alkali metal or alkaline earth metal component is used in addition to an organic base as a base component, as described in Japanese Patent Application No. 69597/83 (corresponding to Japanese Patent Application (OPI) No. 195237/84); hydroxame carbamates as described in Japanese Patent Application No. 43860/83 (corresponding to U.S. Pat. No. 4,511,650), in which a Lossen rearrangement is utilized to produce a base; and aldoxime carbamates capable of forming a nitrile under heat as described in Japanese Patent Application No. 31614/83 (corresponding to U.S. Pat. No. 4,499,180). In addition, other base precursors as described in British Pat. No. 998,945, U.S. Pat. No. 3,220,846, Japanese Patent Application (OPI) No. 22625/75 and British Pat. No. 2,079,480 are also useful.

(c) Nucleophilic Compounds:

Water and water releasing compounds, amines, amidines, guanidines, hydroxylamines, hydrazines, hydrazides, oximes, hydroxamic acids, sulfonamides, active methylene compounds, alcohols and thiols are useful, and salts and precursors of these compounds may also be used.

(d) Oils:

High boiling point organic solvents (i.e., "plasticizers") which are used for emulsification and dispersion of hydrophobic compounds may be used in the present invention.

(e) Thermal Solvents:

Thermal solvents are solid at room temperature but melt at about a development temperature to act as a solvent, including ureas, urethanes, amides, pyridines, sulfonamides, sulfones, sulfoxides, esters, ketones, ethers or the like compounds, which are solid at about 40° C. or lower.

(f) Surfactants:

Pyridinium salts, ammonium salts, phosphonium salts as described in Japanese Patent Application (OPI) No. 74547/84; and polyalkylene oxides as described in Japanese Patent Application (OPI) No. 57231/84 may be used.

(g) Compounds Having Mutual Reactivity with Silver or Silver Ion:

Imides; nitrogen-containing heterocyclic compounds as described in Japanese Patent Application No. 51657/83 (corresponding to Japanese Patent Application (OPI) No. 177550/84); and thiols, thioureas and thioethers as described in Japanese Patent Application No. 222247/82 (corresponding to British Patent Application No. 2,135,465A) may also be used.

The image forming accelerator may be incorporated in any of the photographic material and the dye fixing material of the present invention or may be incorporated in both of these materials. The accelerator may be incorporated in any of the emulsion layer, intermediate layer, protective layer, dye fixation layer or the adjacent layers thereof. When both the photographic layer and the dye fixing layer are provided on the surface of the same support, the image forming accelerator may be incorporated in the same manner as mentioned above.

The image forming accelerator may be used alone, or alternatively, several accelerators may be used together, and in general, a mixture of image forming accelerators is preferred, resulting in a greater image forming acceleration effect.

In particular, the combination use of a base or base precursor and another accelerator is preferred to provide an extremely remarkable image forming acceleration effect.

In the present invention, various development stopping agents may be used for the purpose of constantly obtaining a predetermined image density, irrespective of the variation of treatment temperature and treatment time during heat development.

The term "development stopping agent" as used herein designates a compound which may rapidly neutralize a base or react therewith, after completion of sufficient development, to lower the base concentration in the photographic film thereby to stop the development, or a compound which may mutually react with the existing silver or silver salt thereby to inhibit the development reaction. Examples of such development stopping agents include acid precursors capable of releasing an acid under heat, electrophilic compounds capable of reacting (replacement reaction) with a coexisting base under heat, nitrogen-containing heterocyclic compounds and mercapto compounds. Specific examples of said acid precursors include oxime esters as described in Japanese Patent Application Nos. 216928/83 (corresponding to Japanese Patent Application (OPI) No. 108837/85) and 48305/84 (corresponding to Japanese Patent Application (OPI) No. 192939/85), and compounds capable of releasing an acid by Lossen rearrangement as described in Japanese Patent Application No. 85834/84 (corresponding to U.S. patent Ser. No. 727,718, filed on Apr. 26, 1985, and West German Patent Application (OLS) No. 3,515,176). Examples of electrophilic compounds capable of reacting with a coexisting base under heat by a replacement reaction are described in Japanese Patent Application No. 85836/84 (corresponding to U.S. patent Ser. No. 727,978, filed on Apr. 26, 1985, and European Patent Application No. 159,725A).

It is especially preferred that the development stopping agent contain a base precursor, and in this case, the molar ratio of (base precursor)/(acid precursor) is preferably about 1/20 to 20/1, more preferably about 1/5 to 5/1.

The photographic materials of the present invention may further contain additional compounds for the purpose of activation of development and stabilization of the image formed. Examples of especially preferred compounds for these purposes are isothiuroniums such as 2-hydroxyethyl-isothiuronium.trichloroacetate described in U.S. Pat. No. 3,301,678; bisisothiuroniums such as 1,8-(3,6-dioxaoctane)bis(isothiuronium.trichloroacetate) described in U.S. Pat. No. 3,669,670; thiol compounds described in West German Patent Application (OLS) No. 2,162,714; thiazolium compounds such as 2-amino-2-thiazolium.trichloroacetate, 2-amino-5bromoethyl-2-thiazolium.trichloroacetate described in U.S. Pat. No. 4,012,260; and compounds having an acidic 2-carboxycarboxyamido group, such as bis(2-amino-2-thiazolium)methylenebis(sulfonylacetate), 2-amino-2-thiazolium phenylsulfonylacetate, described in U.S. Pat. No. 4,060,420.

In addition, other compounds may preferably be used in the present invention, for example, azolethioethers and blocked azolylthione compounds described in Belgian Pat. No. 768,071; 4-aryl-1-carbamyl-2-tetrazolyl-5-thione compounds described in U.S. Pat. No. 3,893,859; and compounds described in U.S. Pat. Nos. 3,839,041, 3,844,788 and 3,877,940.

In the present invention, an image toning agent may optionally be used. Effective toning agents are 1,2,4-triazole, 1H-tetrazole, thiouracil, 1,3,4-thiadiazole or the like compounds. Preferred examples of these toning agents include 5-amino-1,3,4-thiadiazole-2-thiol, 3-mercapto-1,2,4-triazole, bis(dimethylcarbamyl)disulfide, 6-methylthiouracil and 1-phenyl-2-tetrazolyl-5-thione. Especially preferred toning agents are compounds capable of forming black images.

The concentration of the toning agent incorporated in the photographic material of the present invention varies depending upon the kind of photographic materials, the treatment condition employed and the kind of desired image and other various conditions, but, in general, the amount of toning agent used is about 0.001 to 0.1 mol per mol of silver contained in the photographic material.

The present photographic material contains a binder in the form of a single binder or in the form of a mixture of two or more binders. The binder is preferably hydrophilic. In particular, transparent or translucent hydrophilic binders are useful, including, for example, natural substances such as proteins, e.g., gelatin, gelatin derivatives or cellulose derivatives, and polysaccharides such as starch or gum arabic; and synthetic polymer substances such as water-soluble polyvinyl compounds, e.g., polyvinylpyrrolidone or acrylamide polymer. In addition, other synthetic polymer substances may also be used as a binder, such as dispersive vinyl compounds in the form of a latex, which may especially increase the dimensional stability of the photographic material.

The amount of the binder generally coated is about 20 $g/m^2$ or less, preferably about 10 $g/m^2$ or less, more preferably about 7 $g/m^2$ or less, in each layer containing the binder.

The amount of the organic solvent having a high boiling point dispersed in the binder together with a hydrophobic compound such as a dye providing substance is suitably about 1 ml or less (of solvent) in 1 g (of the binder), preferably about 0.5 ml or less (of solvent), more preferably about 0.3 ml or less (of solvent) in 1 g (of binder).

The photographic element and the dye fixing element of the present invention may contain an inorganic or organic hardener, in the photographic emulsion layer(s) and/or other binder-containing layer(s) of the element(s). Examples of hardeners which may be used in the present invention include chromium salts (such as chromium alum and chromium acetate), aldehydes (such as formaldehyde, glyoxal and glutaraldehyde), N-methylol compounds (such as dimethylolurea and methyloldimethylhydantoin), dioxane derivatives (such as 2,3-dihydroxydioxane), active vinyl compounds (such as 1,3,5-triacryloyl-hexahydro-s-triazine, 1,3-vinylsulfonyl-2-propanol and 1,2-bis(vinylsulfonylacetamido)ethane), active halogeno compounds (such as 2,4-dichloro-6-hydroxy-s-triazine) and mucohalogenic acids (such as mucochloric acid and mucophenoxychloric acid). These may be used alone or as a mixture of two or more.

The support on which the photographic element and the dye fixing element are provided according to the present invention must be capable of resisting the treating temperature employed in development. In general, glass, paper, metal or similar conventional materials may be used as the present support, and in addition, acetyl cellulose film, cellulose ester film, polyvinyl acetate film, polystyrene film, polycarbonate film, polyethylene terephthalate film or related films or resin materials may be used as the support. Moreover, a laminated paper support formed by lamination of a polymer such as polyethylene on paper may also be used. Polyesters as described in U.S. Pat. Nos. 3,634,089 and 3,725,070 are preferably used in the present invention.

When the photographic material of the present invention includes a dye providing substance of general formula (LI) as described above, it is generally unnecessary to provide further irradiation preventive substance, halation preventive substance or other dyes in the photographic material, since the dye providing substance is colored. A filter dye or an absorptive substance, as described in Japanese Patent Publication No. 3692/73 and U.S. Pat. Nos. 3,253,921, 2,527,583 and 2,956,879, may be present in the photographic material, particularly for the purpose of improving the sharpness of the image formed. Dyes which may be used for this purpose are preferably dyes capable of being discolored by heat, and preferred dyes are described in U.S. Pat. Nos. 3,769,019, 3,745,009 and 3,615,432.

The photographic materials of the present invention may optionally contain various conventional additives which are known in the field of heat developable photographic materials, and in addition, may optionally have other conventional layers than the light-sensitive layers, such as an antistatic layer, an electroconductive layer, a protective layer, an intermediate layer, an AH layer and a peeling layer. Examples of additives which may be used in the light-sensitive materials of the present invention are described in *Research Disclosure,* Vol. 170 (June, 1978), No. 17029, and include, for example, a plasticizer, a sharpness improving dye, an AH dye, a sensitizing dye, a matting agent, a surfactant, a brightening agent, a fading preventing agent or other conventional additives.

In order to form color over the wide area within chromaticity figure using three primary colors containing yellow, magenta and cyan, the photographic material according to the present invention need to have at least three silver halide emulsion layers each having different color sensitivity from one another.

The representative examples of combinations of at least three light-sensitive silver halide emulsion layers each having different color sensitivity from one another include a combination of a blue-sensitive emulsion layer, a green-sensitive emulsion layer and a red-sensitive emulsion layer, a combination of a green-sensitive emulsion layer, a red-sensitive emulsion layer, an infrared-sensitive emulsion layer, a combination of a blue-sensitive emulsion layer, a green-sensitive emulsion layer and an infrared-sensitive emulsion layer, a combination of a blue-sensitive emulsion layer, a red-sensitive emulsion layer and an infrared-sensitive emulsion layer, etc. However, the infrared-sensitive emulsion layer refers to an emulsion layer having sensitivity to light of 700 nm or more, in particular, 740 nm or more.

The photographic material according to the present invention may include two or more layers having the same color sensitivity but having different sensitivity, if necessary.

The above described each emulsion layer and/or each light-insensitive hydrophilic colloild layer adjacent to each emulsion layer need to include any one of a dye providing substance capable of releasing or forming a yellow hydrophilic dye, a dye providing substance capable of releasing or forming a magenta hydrophilic dye and a dye providing substance capable of releasing or forming a cyan hydrophilic dye. That is to say, each emulsion layer and/or each light-insensitive hydrophilic colloid layer adjacent to each emulsion layer need to include the dye providing substance capable of releasing or forming any one of the hydrophilic dyes having different hues. If desired, a mixture of two or more of dye providing substances having the same hue may be used. In particular, when the dye providing substance is initially colored, it is advantageous that the dye providing substance is added to an under layer of the emulsion layer. The photographic material according to the present invention can include auxiliary layers such as a protective layer, an intermediate layer, an anti-static layer, a curl preventing layer, a peeling layer, a matting layer, etc., as well as the above described layers, if necessary.

In particular, to the protective layer (PC) are conventionally added an organic or inorganic matting agent for preventing adhesion. Further, a mordanting agent, a UV absorbing agent may be added to the protective layer. The protective layer and the intermediate layer each may comprise two or more layers.

Further, the intermediate layer may comprise a reducing agent, a UV absorbing agent, a white pigment such as $TiO_2$ for preventing color mixture. The white pigment may be added to not only the intermediate layers but also the emulsion layers for the purpose of increasing sensitivity.

In order to impart each color sensitivity as described above to each silver halide emulsion, the silver halide emulsion can be subjected to spectral sensitization with the known sensitizing dyes so as to obtain the desired spectral sensitivity.

In the present invention, when electro-heating is employed as developing method, a transparent or opaque heat generating element can be prepared by utilizing the conventional techniques on a resistant heat generator.

As the resistant heat generator, there are a method for utilizing a thin film of an inorganic material showing a property which semiconductor provides and a method for utilizing a thin film of an organic substance in which conductive fine particles are dispersed into binder. The examples of materials utilized for the former method include silicon carbide, molybdenum silicide, lanthanide chromate, barium titanate ceramics used for PTC thermistor, thin oxide, zinc oxide, by which the transparent or opaque thin film can be prepared according to the known method. According to the latter method, resistors having the desired temperature characteristics can be prepared by dispersing conductive fine particles such as metallic fine particles, carbon black, graphite, etc., into a rubber, a synthetic polymer and gelatin. These resistors may be directly contacted with the photographic element or may be separated from the photographic elements with a support, intermediate layer etc.

The examples of positional relationship of the heat generating element against the photographic element are shown below.

Heat generating element/Support/Photographic element

Support/Heat generating element/Photographic element

Support/Heat generating element/Intermediate layer/Photographic element

Support/Photographic element/Heat generating element

Support/Photographic element/Intermediate layer/-Heat generating element

The protective layer, the intermediate layer, the subbing layer, the back layer, dye fixing layer and other layers can be produced by preparing each coating solution and applying to a support by various coating methods such as a dip coating method, an air knife coating method, a curtain coating method or a hopper coating method as described in U.S. Pat. No. 2,681,294 and drying in the same manner as used in preparing the heat developable photographic layer of the present invention, by which the photographic material or dye fixing material is obtained.

If necessary, two or more layers may be applied at the same time by the method as described in U.S. Pat. No. 2,761,791 and British Pat. No. 837,095.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light emitting diodes (LED), etc.

In the present invention, after the heat developable color photographic material is exposed to light, the resulting latent image can be developed by heating the whole material to a suitably elevated temperature, for example, about 80° C. to about 250° C. A higher temperature or lower temperature can be utilized to prolong or shorten the heating time, if it is within the above described temperature range. Particularly, a temperature range of about 110° C. to about 180° C. is useful. Among these ranges, a temperature range of 140° C. or more is preferable and a temperature range of 150° C. or more is particularly preferable.

As the heating means, a simple heat plate, iron, heat roller, heat generator utilizing carbon or titanium white, etc., or analogues thereof may be used.

The present invention will be explained in greater detail by reference to the following examples, which, however, are not intended to be interpreted as limiting the scope of the present invention. Unless otherwise indicated, all parts, percents and ratios are by weight.

EXAMPLE 1

On a paper support laminated with polyethylene containing a titanium dioxide dispersion were coated a subbing layer and a dye fixing layer in this order, as shown in the following Table 1, and the samples were dried to obtain Dye Fixing Materials (R-1) through (R-5).

Next, the amount of water which is necessary for maximally swelling the coated layer of each of the dye fixing materials was determined according to the method as described in *Photographic Science and Engineering*, Vol. 16, pp. 449–452.

In addition, each material was dipped in water for 2 seconds, 4 seconds and 10 seconds and then the excess water adhering to the surface of said material was squeezed out with rollers. The weight of the thus swollen material was measured to determine the amount of water absorbed by said material.

The results are given in Table 1.

It is apparent from the results in Table 1 that Dye Fixing Materials (R-3), (R-4) and (R-5) according to the present invention are capable of absorbing a large amount of water in a short period of time.

nitrate dissolved in 100 ml of water was added to the solution in the course of 2 minutes.

The pH value of this silver benzotriazole emulsion was regulated and then sedimented to remove the excess salts therefrom. Afterwards, the pH value thereof was adjusted to 6.30 to obtain 400 g of the desired silver benzotriazole emulsion.

A silver halide emulsion used in the fifth layer was prepared as follows:

1,000 ml of an aqueous solution containing potassium iodide and potassium bromide and a silver nitrate aqueous solution (obtained by dissolving 1 mol of silver nitrate in 600 ml of water) were added at the same time to a well stirred gelatin aqueous solution (obtained by dissolving 20 g of gelatin and ammonia in 1,000 ml of water and kept at 50° C.), while the pAg value of the resultant solution was kept at a determined value. Thus, a monodispersed octahedral silver bromoiodide emul-

TABLE 1

| | R-1 (Comparison) | | | R-2 (Comparison) | | | R-3 (Invention) | | | R-4 (Invention) | | | R-5 (Invention) | | |
|---|---|---|---|---|---|---|---|---|---|---|---|---|---|---|---|
| Dye fixing layer | Lime-processed gelatin (4 g/m²) Mordant A*1 (4 g/m²) Cross-linking agent*3 (0.16 g/m²) | | | Lime-processed gelatin (4 g/m²) Mordant B*2 (4 g/m²) | | | Lime-processed gelatin (4 g/m²) Mordant B*2 (4 g/m²) | | | Lime-processed gelatin (2.8 g/m²) Mordant B*2 (4 g/m²) Polyvinyl-pyrrolidone*4 (1.2 g/m²) | | | Lime-processed gelatin (2.8 g/m²) Mordant B*2 (4 g/m²) Polyvinyl-pyrrolidone*4 (1.2 g/m²) | | |
| Subbing layer | — | | | Lime-processed gelatin (2.4 g/m²) Cross-linking agent*3 (0.2 g/m²) | | | Lime-processed gelatin (1.6 g/m²) Gum arabic (0.8 g/m²) Cross-linking agent*3 (0.2 g/m²) | | | Lime-processed gelatin (1.6 g/m²) Gum arabic (0.8 g/m²) Cross-linking agent*3 (0.2 g/m²) | | | Lime-processed gelatin (2.4 g/m²) Cross-linking agent*3 (0.2 g/m²) | | |
| Support | Paper support laminated with polyethylene containing a titanium dioxide dispersion | | | | | | | | | | | | | | |
| Amount of water required for maximum swelling | 5.0 g/m² | | | 17 g/m² | | | 20 g/m² | | | 28 g/m² | | | 25 g/m² | | |
| Amount of absorbed water (after squeezed the excess water with rollers) (g/m²) | 2 sec | 4 sec | 10 sec | 2 sec | 4 sec | 10 sec | 2 sec | 4 sec | 10 sec | 2 sec | 4 sec | 10 sec | 2 sec | 4 sec | 10 sec |
| | 1.3 | 3 | 4.7 | 4 | 10 | 15 | 8 | 16 | 18 | 11 | 22 | 25 | 10 | 20 | 23 |

*1: 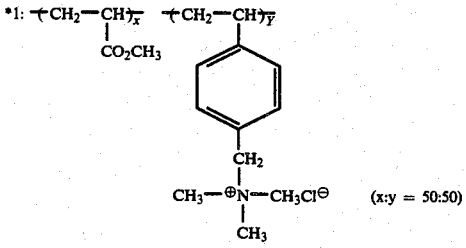
(x:y = 50:50)

*2: 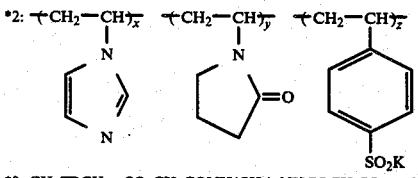
(x:y:z = 62.5:31.25:6.25)

*3: $CH_2{=}CH{-}SO_2CH_2CONH(CH_2)_2NHCOCH_2SO_2{-}CH{=}CH_2$

*4: K-90 (manufactured by Gokyo Sangyo K.K.), having average molecular weight of about 300,000.

EXAMPLE 2

A silver benzotriazole emulsion was prepared as follows:

28 g of gelatin and 13.2 g of benzotriazole were dissolved in 300 ml of water. The solution formed was kept at 40° C. and stirred, while a solution of 17 g of silver sion (iodide content: 5 mol%) having an average grain size of 0.50 μm was obtained.

After the emulsion was washed with water and demineralized, 5 mg of chloroauric acid (tetrahydrate) and 2 mg of sodium thiosulfate were added to the emulsion obtained, which was heated at 60° C. for gold- and sulfur-sensitization thereof. The yield of the emulsion formed was 1 kg.

Next, a silver halide emulsion for the third layer was prepared as follows:

600 ml of an aqueous solution containing sodium chloride and potassium bromide, a silver nitrate aqueous solution (containing 0.59 mol of silver nitrate dissolved in 600 ml of water) and Dye Solution (I) as described below were simultaneously added to a well stirred gelatin aqueous solution (containing 20 g of gelatin and 3 g of sodium chloride dissolved in 1,000 ml of water and warmed at 75° C.), in the course of 40 minutes at the same addition flow rate. Thus, a monodispersed cubic silver bromochloride emulsion (bromide content: 80 mol%) having an average grain size of 0.35 μm, to which was adsorbed a dye, was obtained.

After the emulsion was washed with water and demineralized, 5 mg of sodium thiosulfate and 20 mg of 4-hydroxy-6-methyl-1,3,3a,7-tetraazaindene were added to the emulsion obtained, which was heated at 60° C. for chemical sensitization thereof. The yield of the emulsion formed was 600 g.

Dye Solution (I):

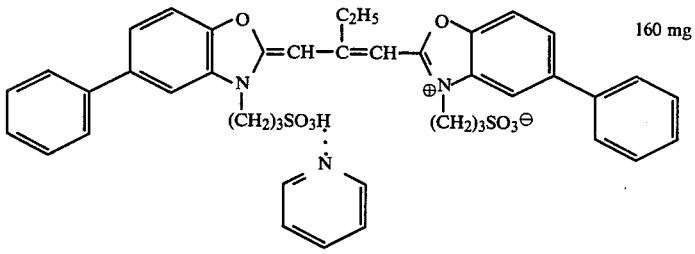

160 mg

Methanol 400 ml

Next, a silver halide emulsion for the first layer was prepared as follows:

600 ml of an aqueous solution containing sodium chloride and potassium bromide and a silver nitrate aqueous solution (containing 0.59 mol of silver nitrate dissolved in 600 ml of water) were simultaneously added to a well stirred gelatin aqueous solution (containing 20 g of gelatin and 3 g of sodium chloride dissolved in 1,000 ml of water and warmed at 75° C.), in the course of 40 minutes, at the same addition flow rate. Thus, a monodispersed cubic silver bromochloride emulsion (bromide content: 80 mol%) having an average grain size of 0.35 μm was obtained.

After the emulsion was washed with water and demineralized, 5 mg of sodium thiosulfate and 20 mg of 4-hydroxy-6-methyl-1,3,3a,7-tetraazaindene were added to the emulsion obtained, which was heated at 60° C. for chemical sensitization thereof. The yield of the emulsion formed was 600 g.

Next, a gelatin dispersion of a dye providing substance was prepared as follows:

5 g of Yellow Dye Providing Substance (A) (as described below), 0.5 g of 2-ethylhexyl succinate/sodium sulfonate (as surfactant) and 10 g of triisononyl phosphate were weighed, and 30 ml of ethyl acetate was added thereto and heated at about 60° C. and dissolved to obtain a uniform solution. The resultant solution was blended with 100 g of a 10% solution of lime-processed gelatin with stirring, and then dispersed in a homogenizer for 10 minutes (10,000 rpm), to obtain a yellow dye providing substance dispersion.

In the same manner as mentioned above, with the exception that Magenta Dye Providing Substance (B) (as described below) was used instead of Yellow Dye Providing Substance (A) and that 7.5 g of tricresyl phosphate was used as a high boiling point solvent instead of triisononyl phosphate, a magenta dye providing substance dispersion was obtained.

In addition, a cyan dye providing substance dispersion was formed using Cyan Dye Providing Substance (C) (as described below), in the same manner as mentioned above.

Using these materials, a color photographic material having the multilayer construction shown in the following Table 2 was produced.

Dye Providing Substance (A):

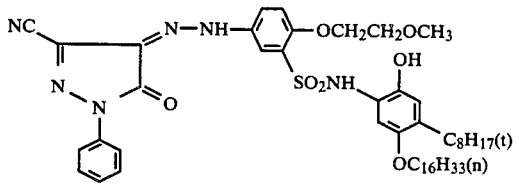

Dye Providing Substance (B):

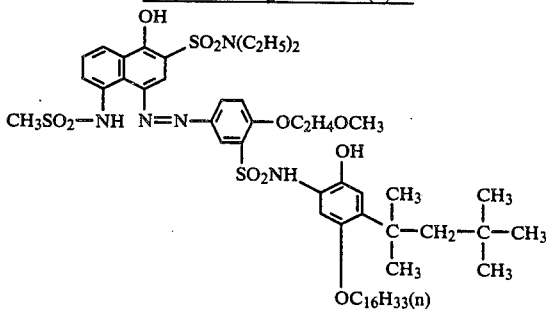

Dye Providing Substance (C):

-continued

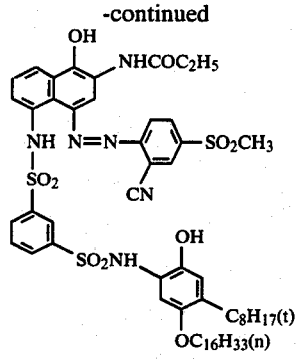

TABLE 2

| | |
|---|---|
| 6th Layer: | Gelatin (coated amount: 1,000 mg/m$^2$), base precursor*3 (coated amount: 600 mg/m$^2$) |
| 5th Layer: | Blue-Sensitive Emulsion Layer: Silver bromoiodide emulsion (iodide: 5 mol %, coated amount: silver 400 mg/m$^2$), dimethylsulfamide (coated amount: 180 mg/m$^2$), silver benzotriazole emulsion (coated amount: silver 100 mg/m$^2$), base precursor*3 (coated amount: 500 mg/m$^2$), Yellow Dye Providing Substance (A) (coated amount: 400 mg/m$^2$), gelatin (coated amount: 1,000 mg/m$^2$), high boiling point solvent*4 (coated amount: 800 mg/m$^2$), surfactant*2 (coated amount: 100 mg/m$^2$) |
| 4th Layer: | Intermediate Layer: Gelatin (coated amount: 1,200 mg/m$^2$), base precursor*3 (coated amount: 600 mg/m$^2$) |
| 3rd Layer: | Green-Sensitive Emulsion Layer: Silver bromochloride emulsion (bromide: 80 mol %, coated amount: silver 300 mg/m$^2$), dimethylsulfamide (coated amount: 180 mg/m$^2$), silver benzotriazole emulsion (coated amount: silver 100 mg/m$^2$), base precursor*3 (coated amount: 500 mg/m$^2$), Magenta Dye Providing Substance (B) (coated amount: 400 mg/m$^2$), gelatin (coated amount: 1,000 mg/m$^2$), high boiling point solvent*1 (coated amount: 600 mg/m$^2$), surfactant*2 (coated amount: 100 mg/m$^2$) |
| 2nd Layer: | Intermediate Layer: Gelatin (coated amount: 1,000 mg/m$^2$), base precursor*3 (coated amount: 600 mg/m$^2$) |
| 1st Layer: | Red-Sensitive Emulsion Layer: Silver bromochloride emulsion (bromide: 80 mol %, coated amount: silver 300 mg/m$^2$), benzenesulfonamide (coated amount: 180 mg/m$^2$), silver benzotriazole emulsion (coated amount: silver 100 mg/m$^2$), sensitizing dye*5 (coated amount: 8 × 10$^{-7}$ mol/m$^2$), base precursor*3 (coated amount: 500 mg/m$^2$), Cyan Dye Providing Substance (C) (coated amount: 300 mg/m$^2$), gelatin (coated amount: 1,000 mg/m$^2$), high boiling point solvent*4 (coated amount: 600 mg/m$^2$), surfactant*2 (coated amount: 100 mg/m$^2$) |
| Support: | Polyethylene Terephthalate Film |

*1Tricresyl phosphate

*2 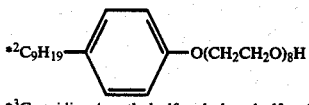

*3Guanidine 4-methylsulfonyl-phenylsulfonyl-acetate

*4(iso-$C_9H_{19}O)_3P{=}O$

*5 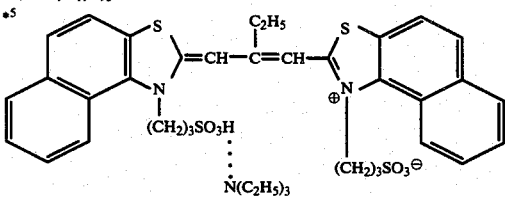

The color photographic material of multilayer construction as described above was exposed to light of 2,000 luxes for 1 second, which was obtained by using a tungsten lamp and passing the light through a B-G-R three color separation filter having a continuously varying color density distribution. After the exposure, the material was uniformly heated on a heat block heated at 140° C. for 30 minutes.

Next, each of Dye Fixing Materials (R-1) through (R-5) formed in Example 1 was dipped in water for 2 seconds and then the excess water adhering to the surface of the material was immediately squeezed out with rollers. Each of the thus swollen materials was closely attached to the above formed photographic material, with the surfaces of the coated layers of the two materials facing each other. After being heated for 6 seconds on a heat block at 80° C., the dye fixing material was peeled off from the photographic material, whereby yellow, magenta and cyan images were formed on the dye fixing material corresponding to the B-G-R separation filter, respectively. The maximum density (Dmax) and the minimum density (Dmin) of each of the color images formed were measured with a Macbeth reflection densitometer (RD-519).

In the same manner as mentioned above, with the exception that the time for dipping the dye fixing materials in water was varied to 4 seconds and 10 seconds, development and dye transfer were performed as above and the density of the dye formed was measured. The results are given in the following Table 3, where the degree of transferred density mottle in the color images obtained using each material was compared.

The results in Table 3 prove that the dye fixing materials of the present invention are superior to the comparative samples in that transferred color images of high maximum density (Dmax) with less mottle may be obtained even though the time required for dipping the dye fixing material in water is short. In particular, the effect of the sample containing the non-cross-linked hygroscopic polymer (polyvinylpyrrolidone) in its dye fixing layer is remarkable.

TABLE 3

| | Dipping Time | Density | Comparative Sample R-1 | Comparative Sample R-2 | Present Invention R-3 | Present Invention R-4 | Present Invention R-5 |
|---|---|---|---|---|---|---|---|
| Yellow | 2 sec | Dmax | 1.03 | 1.15 | 1.67 | 1.96 | 1.90 |
| | | Dmin | 0.12 | 0.13 | 0.14 | 0.14 | 0.14 |
| | 4 sec | Dmax | 1.28 | 1.40 | 1.83 | 2.03 | 1.95 |
| | | Dmin | 0.13 | 0.14 | 0.14 | 0.14 | 0.14 |
| | 10 sec | Dmax | 1.59 | 1.81 | 2.06 | 2.11 | 2.07 |
| | | Dmin | 0.14 | 0.14 | 0.14 | 0.14 | 0.14 |
| Magenta | 2 sec | Dmax | 1.06 | 1.81 | 1.56 | 1.98 | 1.91 |
| | | Dmin | 0.12 | 0.12 | 0.13 | 0.13 | 0.13 |
| | 4 sec | Dmax | 1.43 | 1.72 | 2.01 | 2.23 | 2.19 |
| | | Dmin | 0.12 | 0.13 | 0.13 | 0.13 | 0.13 |
| | 10 sec | Dmax | 1.70 | 1.89 | 2.38 | 2.42 | 2.39 |
| | | Dmin | 0.13 | 0.13 | 0.13 | 0.13 | 0.13 |
| Cyan | 2 sec | Dmax | 1.01 | 1.25 | 1.73 | 2.02 | 1.93 |
| | | Dmin | 0.12 | 0.12 | 0.13 | 0.13 | 0.13 |
| | 4 sec | Dmax | 1.41 | 1.59 | 1.98 | 2.27 | 2.15 |
| | | Dmin | 0.12 | 0.13 | 0.13 | 0.13 | 0.13 |
| | 10 sec | Dmax | 1.78 | 1.93 | 2.30 | 2.49 | 2.41 |
| | | Dmin | 0.13 | 0.13 | 0.13 | 0.13 | 0.13 |
| Transferred density mottle | | | Large | Middle | Small | Almost absent | Almost absent |

EXAMPLE 3

In the same manner as in Example 2, with the exception that the color photographic material of multilayer construction produced according to Example 2 was exposed to light through a wedge for determination of resolving power, the photographic material was exposed and then subjected to heat development.

Each of Dye Fixing Materials (R-2) and (R-5) produced in Example 1 was dipped in water for 4 seconds and then immediately (i.e., without removing any excess water adhering on the surface of the material with rollers) attached to the above developed photographic material, with the surfaces of the coated layers of the two materials facing each other, and thereafter heated to accomplish dye transference in the same manner as in Example 2 (Case A). Apart from Case A, each of Dye Fixing Materials (R-2) and (R-5) was dipped in water for 4 seconds and then the excess water adhering to the surface of the material was squeezed out with rollers, and thereafter attached to the above developed photographic material and then heated for dye transference in the same manner as above (Case B).

The resolving power of each of the transferred color images obtained as above is shown in the following Table 4.

TABLE 4

| Case | | Resolving Power (line pair/mm) R-2 | R-5 |
|---|---|---|---|
| Cyan | A | 8–9 | 7–8 |
| | B | 10 or more | 10 or more |
| Magenta | A | 6–7 | 5–6 |
| | B | 10 or more | 10 or more |
| Yellow | A | 2–3 | 1–2 |
| | B | 10 or more | 10 or more |

From the results of the above Table 4, it is noted that if a wetted dye fixing material is attached to a dye containing photographic material directly or without squeezing the excess water adhering to the surface of the dye fixing material and heated for dye transference, the resolving power of the transferred color image is remarkably lowered. This tendency is more remarkable in the color image existing in the upper layer.

EXAMPLE 4

A silver benzotriazole emulsion was prepared in the same manner as in Example 2.

A silver halide emulsion to be used in the fifth layer and the first layer was prepared as follows.

600 ml of an aqueous solution containing sodium chloride and potassium bromide and a silver nitrate aqueous solution (containing 0.59 mol of silver nitrate dissolved in 600 ml of water) were simultaneously added to a well stirred gelatin aqueous solution (containing 20 g of gelatin and 3 g of sodium chloride dissolved in 1,000 ml of water and warmed at 75° C.) in the course of 40 minutes at the same addition flow rate. Thus, a monodispersed cubic silver bromochloride emulsion (bromide content: 50 mol%) having an average grain size of 0.40 μm was obtained.

After the emulsion was washed with water and demineralized, 5 mg of sodium thiosulfate and 20 mg of 4-hydroxy-6-methyl-1,3,3a,7-tetraazaindene were added to the emulsion obtained, which was heated at 60° C. for chemical sensitization thereof.

The yield of the emulsion formed was 600 g.

Next, a silver halide emulsion for the third layer was prepared as follows:

600 ml of an aqueous solution containing sodium chloride and potassium bromide and a silver nitrate aqueous solution (containing 0.59 mol of silver nitrate dissolved in 600 ml of water) were simultaneously added to a well stirred gelatin aqueous solution (containing 20 g of gelatin and 3 g of sodium chloride dissolved in 1,000 ml of water and warmed at 75° C.) in the course of 40 minutes at the same addition flow rate. Thus, a monodispersed cubic silver bromochloride emulsion (bromide content: 80 mol%) having an average grain size of 0.35 μm was obtained.

After the emulsion was washed with water and demineralized, 5 mg of sodium thiosulfate and 20 mg of 4-hydroxy-6-methyl-1,3,3a,7-tetraazaindene were added to the emulsion obtained, which was heated at 60° C. for chemical sensitization thereof. The yield of the emulsion formed was 600 g.

In addition, gelatin dispersion of dye providing substances were formed in the same manner as in Example 2.

Using these materials, a color photographic material having a multilayer construction as shown in the following Table 5 was produced.

TABLE 5

| | |
|---|---|
| 6th Layer: | Gelatin (coated amount: 1,000 mg/m$^2$), base precursor*3 (coated amount: 600 mg/m$^2$), silica*5 (coated amount: 100 mg/m$^2$) |
| 5th Layer: | Green-Sensitive Emulsion Layer: Silver bromochloride emulsion (bromide: 50 mol %, coated amount: silver 400 mg/m$^2$), benzenesulfonamide (coated amount: 180 mg/m$^2$), silver benzotriazole emulsion (coated amount: silver 100 mg/m$^2$), Sensitizing Dye D-1 (coated amount: $10^{-6}$ mol/m$^2$), base precursor*3 (coated amount: 500 mg/m$^2$), Yellow Dye Providing Substance (A) (coated amount: 400 mg/m$^2$), gelatin (coated amount: 1,000 mg/m$^2$), high boiling point solvent*4 (coated amount: 800 mg/m$^2$), surfactant*2 (coated amount: 100 mg/m$^2$) |
| 4th Layer: | Intermediate Layer: Gelatin (coated amount: 1,200 mg/m$^2$), base precursor*3 (coated amount: 600 mg/m$^2$) |
| 3rd Layer: | Red-Sensitive Emulsion Layer: Silver bromochloride emulsion (bromide: 80 mol %, coated amount: silver 300 mg/m$^2$), benzenesulfonamide (coated amount: 180 mg/m$^2$), silver benzotriazole emulsion (coated amount: silver 100 mg/m$^2$), Sensitizing Dye D-2 (coated amount: $8 \times 10^{-7}$ mol/m$^2$), base precursor*3 (coated amount: 450 mg/m$^2$), Magenta Dye Providing Substance (B) (coated amount: 400 mg/m$^2$), gelatin (coated amount: 1,000 mg/m$^2$), high boiling point solvent*1 (coated amount: 600 mg/m$^2$), surfactant (coated amount: 100 mg/m$^2$) |
| 2nd Layer: | Intermediate Layer: Gelatin (coated amount: 1,000 mg/m$^2$), base precursor*3 (coated amount: 600 mg/m$^2$) |
| 1st Layer: | Infrared-Sensitive Emulsion Layer: Silver bromochloride emulsion (bromide: 50 mol %, coated amount: silver 300 mg/m$^2$), benzenesulfonamide (coated amount: 180 mg/m$^2$), silver benzotriazole emulsion (coated amount: silver 100 mg/m$^2$), Sensitizing Dye D-3 (coated amount: $10^{-5}$ mol/m$^2$), base precursor*3 (coated amount: 500 mg/m$^2$), Cyan Dye Providing Substance (C) (coated amount: 300 mg/m$^2$), gelatin (coated amount: 1,000 mg/m$^2$), high boiling point solvent*4 (coated amount: 600 mg/m$^2$), surfactant*2 (coated amount: 100 mg/m$^2$) |

TABLE 5-continued

Support: Polyethylene Terephthalate Film

*1Tricresyl phosphate

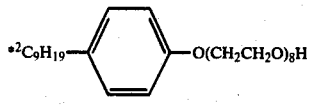

*3$CH_3CONH$—C≡$CCO_2H$ (guanidine salt)

*4(iso-$C_9H_{19}O)_3P$=O

*5size 4 μm

Sensitizing Dye D-1:

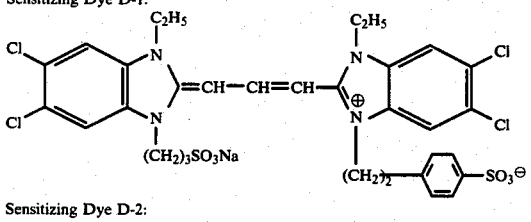

Sensitizing Dye D-2:

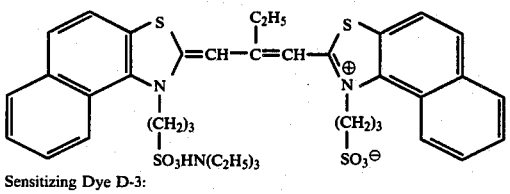

Sensitizing Dye D-3:

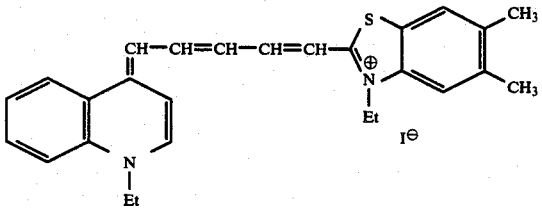

Next, a dye fixing material was prepared as follows:

On a paper support laminated with a polyethylene containing a titanium dioxide dispersion was coated a subbing layer and a dye fixing layer uniformly in the order shown in the following Table 6, which were dried to obtain Dye Fixing Materials (R-6) through (R-11). The amount of water required for maximally swelling the coated layer of each material was determined. In addition, each material was dipped in water for 4 seconds and then the excess water adhering on the surface of the material was squeezed out with rollers, and thus the amount of water in each swollen material was also determined.

Next, the color photographic material of multilayer construction described above was exposed to light of 500 luxes for 1 second, which was obtained by using a tungsten lamp and passing the light through a G-R-IR three color separation filter composed of a 500–600 nm band pass filter for G, 600–700 nm band pass filter for R and a filter to pass 700 nm or more for IR, the color density in the filter continuously varying.

After the exposure, the material was uniformly heated on a heat block at 140° C. for 30 seconds.

Next, each of the dye fixing materials was dipped in water for 4 seconds and then the excess water adhering to the surface of the material was squeezed out with rollers, and thereafter the thus swollen material was closely attached to the above formed photographic material, with the surfaces of the coated layers of the two materials facing each other. After being heated for 6 seconds on a heat block at 80° C., the dye fixing material was peeled off from the photographic material, whereby yellow, magenta and cyan images were formed on the dye fixing material, corresponding to the G-B-IR separation filter, respectively. The maximum density of each color was measured with a Macbeth reflection densitometer (RD-519), and the mottle in the transferred images in each material was evaluated. The results are given in the following Table 6.

The results in Table 6 prove that the dye fixing materials of the present invention (R-7 through R-11) may form transferred color images of high density with less mottle according to the dye-transfer process of the present invention, even though the dye fixing materials are swollen with water for a short period of time.

TABLE 6

| | Comparison | Present Invention | | | | |
|---|---|---|---|---|---|---|
| Components | R-6 | R-7 | R-8 | R-9 | R-10 | R-11 |
| Dye Fixing Layer | | | | | | |
| Lime-processed gelatin | 4.5 g/m² | 2.7 g/m² | 3.5 g/m² | 2.7 g/m² | 2.7 g/m² | 2.7 g/m² |
| Mordant | A*1 4.5 g/m² | A*1 4.5 g/m² | B*2 4.5 g/m² | C*3 4.5 g/m² | A*1 4.5 g/m² | A*1 4.5 g/m² |
| Non-cross-linked hydrophilic polymer | — | Polyvinyl-pyrrolidone*6 1.8 g/m² | Polyvinyl-pyrrolidone*6 1.8 g/m² | Polyvinyl-pyrrolidone*6 1.8 g/m² | Polyethylene glycol*7 1.8 g/m² | Dextran*8 1.8 g/m² |
| Cross-linking agent | — | — | D*4 0.07 g/m² | — | — | — |
| Subbing Layer | | | | | | |
| Lime-processed gelatin | 1.0 g/m² | 1.0 g/m² | — | 1.0 g/m² | 1.0 g/m² | 1.0 g/m² |
| Cross-linking agent | D*4 0.2 g/m² | D*4 0.18 g/m² | — | D*4 0.1 g/m² | D*4 0.2 g/m² | D*4 0.2 g/m² |
| Support | Paper support laminated with polyethylene containing titanium dioxide dispersion | | | | | |
| Amount of water required for maximum swelling | 16 g/m² | 26 g/m² | 23 g/m² | 25 g/m² | 24 g/m² | 22 g/m² |
| Amount of absorbed water | 9 g/m² | 21 g/m² | 18 g/m² | 20 g/m² | 19 g/m² | 18 g/m² |
| Dmax | | | | | | |
| Cyan | 1.57 | 1.99 | 1.91 | 2.01 | 1.98 | 1.96 |
| Magenta | 1.75 | 2.23 | 2.16 | 2.26 | 2.20 | 2.18 |
| Yellow | 1.42 | 2.20 | 2.10 | 2.24 | 2.18 | 2.16 |

TABLE 6-continued

| Components | Comparison R-6 | Present Invention R-7 | R-8 | R-9 | R-10 | R-11 |
|---|---|---|---|---|---|---|
| Mottle | Large | Almost absent | Almost absent | Almost absent | Almost absent | Almost absent |

*1 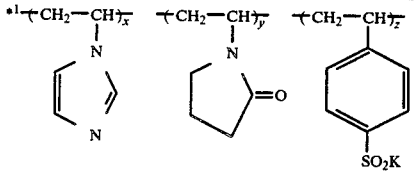

(x:y:z = 62.5:31.25:6.25)

*2 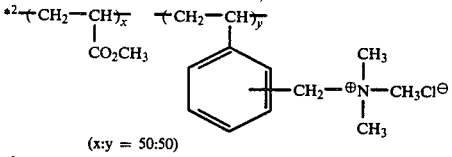

(x:y = 50:50)

*3 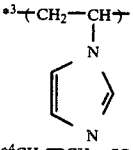

*4 $CH_2{=}CH{-}SO_2CH_2CONH(CH_2)_2CONHCH_2SO_2{-}CH{=}CH_2$
*5 Zinc acetate
*6 Average molecular weight: about 300,000
*7 Polymerization degree: about 100
*8 Average molecular weight: about 500,000

EXAMPLE 5

A silver benzotriazole emulsion was prepared in the same manner as in Example 2.

Next, a silver halide emulsion was prepared as follows:

600 ml of an aqueous solution containing sodium chloride and potassium bromide and a silver nitrate aqueous solution (containing 0.59 mol of silver nitrate dissolved in 600 ml of water) were simultaneously added to a well stirred gelatin aqueous solution (containing 20 g of gelatin and 3 g of sodium chloride dissolved in 1,000 ml of water and warmed at 75° C.) in the course of 40 minutes at the same addition flow rate. Thus, a monodispersed cubic silver bromochloride emulsion (bromide content: 80 mol%) having an average grain size of 0.35 μm was obtained.

After the emulsion was washed with water and demineralized, 5 mg of sodium thiosulfate and 20 mg of 4-hydroxy-6-methyl-1,3,3a,7-tetraazaindene were added to the emulsion obtained, which was heated at 60° C. for chemical sensitization thereof. The yield of the emulsion formed was 600 g.

A gelatin dispersion of Magenta Dye Providing Substance (B) was prepared in the same manner as in Example 2.

Next, a photographic coating composition was prepared as follows:

| | | |
|---|---|---|
| (a) | Silver benzotriazole emulsion | 10 g |
| (b) | Photographic silver bromochloride emulsion | 15 g |
| (c) | Dye Providing Substance (B) dispersion | 25 g |
| (d) | 5% Aqueous solution of the following compound: | 5 ml |

-continued

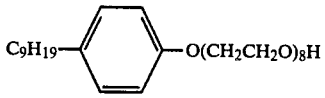

| | | |
|---|---|---|
| (e) | 10% Methanol solution of benzenesulfonamide | 5 ml |
| (f) | 10% Aqueous solution of guanidine 4-methylsulfonylphenyl-sulfonylacetate | 15 ml |
| (g) | 0.04% Methanol solution of the following dye: | 4 ml |

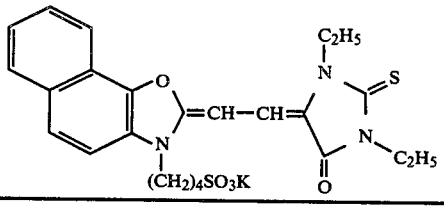

The above components (a) through (g) were blended, and a tackifier and water were added thereto to make 100 ml in all. The solution formed was coated on a polyethylene terephthalate film (having a thickness of 180 μm) to form a layer thereon having a wet layer thickness of 50 μm.

Next, a coating composition for a protective layer was prepared as follows:

| Composition for Protective Layer: | | |
|---|---|---|
| (h) | 10% Gelatin aqueous solution | 400 g |
| (i) | 10% Aqueous solution of guanidine 4-methylsulfonylphenyl-sulfonylacetate | 240 ml |
| (j) | 4% Aqueous solution of the following hardener: $CH_2{=}CH{-}SO_2CH_2CONH(CH_2)_2NHCOCH_2SO_2CH{=}CH_2$ | 50 ml |

The above components (h) through (j) were blended, and a tackifier and water were added thereto to make 1,000 ml in all. The solution formed was coated on the above coated photographic layer to form a protective layer having a thickness of 30 μm.

The thus formed sample was dried and then imagewise exposed to light of 2,000 luxes for 1 second, which was obtained by using a tungsten lamp and passing the light through a green filter.

Afterwards, the sample was heated uniformly on a heat block at 140° C. for 30 seconds.

Next, a dye fixing material having a dye fixing layer was prepared as follows:

0.75 g of Gelatin Hardener (H-1), 0.25 g of Gelatin Hardener (H-2), 155 ml of water, 5 ml of 1% Surfactant (W-1) and 100 g of a 10% lime-processed gelatin aqueous solution were uniformly blended, and the resultant solution was uniformly coated on a paper support laminated with a layer of polyethylene containing a titanium oxide dispersion to form a layer thereon having a wet layer thickness of 60 μm, and then dried.

Gelatin Hardener (H-1):

$CH_2{=}CHSO_2CH_2CONH.CH_2CH_2NHCOCH_2.SO_2CH{=}CH_2$

Gelatin Hardener (H-2):

$CH_2{=}CHSO_2CH_2CONHCH_2.CH_2CH_2NHCOCH_2SO_2CH{=}CH_2$

Surfactant (W-1):

$$\begin{array}{l} \quad\;\; CH_2{-}COO.CH_2{-}CH(C_2H_5)C_4H_9 \\ \quad\;\; | \\ NaO_3S{-}CH_2{-}COO.CH_2{-}CH(C_2H_4)C_4H_9 \end{array}$$

Next, 15 g of a polymer having the following structure and 5 g of polyvinylpyrrolidone (polymerization degree: 3,000) were dissolved in 180 ml of water, and the resultant solution was uniformly blended with 15 ml of 5% Surfactant (W-2), 2 ml of 5% Surfactant (W-3) and 100 g of a 10% lime-processed gelatin, all in aqueous solution. The resultant solution was further coated on the above coated layer to form a protective layer thereon having a wet layer thickness of 85 μm. The thus formed sample was dried to obtain Dye Fixing Material (A).

In the same manner as the formation of Dye Fixing Material (A) but omitting the polyvinylpyrrolidone, another Dye Fixing Material (B) was formed.

Polymer:

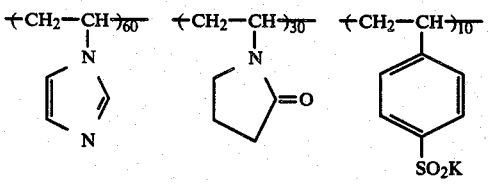

Surfactant (W-2):

$$C_{11}H_{23}CONHCH_2{-}CH_2.CH_2{-}\overset{\oplus}{N}(CH_3)_2{-}CH_2COO^{\ominus}$$

-continued

Surfactant (W-3):

$$C_8F_{17}.SO_2{-}\underset{\underset{C_3H_7}{|}}{N}{-}CH_2COOK$$

The amount of water required for maximally swelling the coated layer of each of Dye Fixing Materials (A) and (B) was determined to be 25 g/m² and 17 g/m², respectively. Each of these materials was dipped in water for 2 seconds and the excess water on the surface of the coated layer was squeezed out with rollers, and the weight of the absorbed water in each of Materials (A) and (B) was determined to be 10 g/m² and 4 g/m², respectively.

Next, each of Dye Fixing Materials (A) and (B) was dipped in water for 2 seconds and then excess water on the surface of the coated layer on each material was squeezed out with rollers. Each of the thus swollen materials was closely attached to the above heat developed sample after it was heat treated, with the surfaces of the coated layers of both materials facing each other.

After being heated on a heat block at 80° C. for 6 seconds, the dye fixing material was peeled off from the photographic material, whereby a magenta image was formed on the dye fixing material. The density of the image formed was measured with a Macbeth reflection densitometer (RD-519). The results are given in the following Table 7.

TABLE 7

| | Dmax | Dmin | Transferred Density Mottle |
|---|---|---|---|
| Material (A) (Present Invention) | 2.30 | 0.15 | Almost absent |
| Material (B) (Comparative Sample) | 2.00 | 0.15 | Large |

The above results prove that Dye Fixing Material (A) of the present invention may form a color image of higher maximum density with less mottle.

EXAMPLE 6

A protective layer was provided on Dye Fixing Material (B) formed in Example 5, as shown in the following Table 8 to obtain Dye Fixing Materials (C) through (K).

A protective layer was provided on Dye Fixing Material (A) formed in Example 5 to obtain Dye Fixing Material (L) shown in Table 8.

These Materials (C) through (L) were photographically treated in the same manner as in Example 5 to form a color image on each material. The maximum density and the minimum density of each color image were measured, and the surface gloss, peelability and mottle were compared with each other. The results are given in Table 8.

TABLE 8

| Dye Fixing Material | Polymer (protective layer) | Average Polymerization Degree | Dmax | Dmin | Surface Gloss* | Peel-ability* | Mottle* |
|---|---|---|---|---|---|---|---|
| C (Comparison) | Lime-processed gelatin (1 g/m²) | — | 1.85 | 0.15 | – | – | – |
| D (Comparison) | Polyacrylamide (PAA) (1 g/m²) | 2,000 | 2.00 | 0.15 | = | + | – |
| E (Comparison) | Polyvinylpyrrolidone (PVP) (1 g/m²) | 3,000 | 2.01 | 0.15 | = | + | – |
| F (Comparison) | Polyvinyl alcohol (PVA) (1 g/m²) | 2,470 | 1.98 | 0.14 | = | + | – |
| G (Comparison) | Polyethylene glycol (PEG) (1 g/m²) | 100 | 2.00 | 0.16 | = | + | – |

TABLE 8-continued

| Dye Fixing Material | Polymer (protective layer) | Average Polymerization Degree | Dmax | Dmin | Surface Gloss* | Peel-ability* | Mottle* |
|---|---|---|---|---|---|---|---|
| H (Invention) | Lime-processed gelatin (0.6 g/m$^2$) and PAA (0.4 g/m$^2$) | — | 2.20 | 0.15 | — | ++ | Almost absent |
| I (Invention) | Lime-processed gelatin (0.6 g/m$^2$) and PVP (0.4 g/m$^2$) | — | 2.25 | 0.15 | — | + | Almost absent |
| J (Invention) | Lime-processed gelatin (0.6 g/m$^2$) and PVA (0.4 g/m$^2$) | — | 2.25 | 0.15 | — | + | Almost absent |
| K (Invention) | Lime-processed gelatin (0.6 g/m$^2$) and PEG (0.4 g/m$^2$) | — | 2.20 | 0.15 | — | + | Almost absent |
| L (Invention) | Lime-processed gelatin (0.6 g/m$^2$) and PVP (0.4 g/m$^2$) | — | 2.35 | 0.16 | — | + | Almost absent |

*+ means noticeable improvement, ++ means extreme improvement, — means no change, and = means deterioration, each as compared with the result of Dye Fixing Material (B) in Example 5.

The results in Table 8 prove that Comparative Samples (C) through (G), on which only a hydrophilic polymer layer was provided, were defective as the maximum density of the color image formed was lowered, the surface of the coated layer was uneven and the surface gloss was lowered. These results also prove that Present Samples (H) through (L) were superior to Comparative Samples (C) through (G) since they formed a color image of higher maximum density, had improved peelability and the mottle in the image formed was almost absent.

It is apparent from the above results that the provision of the protective layer of the present invention on the dye fixing layer results in the improvement of the color image formed (or transferred).

While the invention has been described in detail and with reference to specific embodiments thereof, it will be apparent to one skilled in the art that various changes and modifications can be made therein without departing from the spirit and scope thereof.

What is claimed is:

1. A process which comprises exposing and developing a light-sensitive silver halide material comprising a dye-providing substance capable of forming or releasing a diffusible hydrophilic dye wherein a diffusible dye is transferred to a dye fixing material including the steps of:

(a) applying water to a dye fixing material comprising a support having thereon at least a mordant and a binder, (b) contacting said dye fixing material with said light-sensitive silver halide material, and (c) heating said contacted materials to transfer a dye from said light-sensitive silver halide material to said dye fixing material, wherein said binder contains a cross-linked hydrophilic polymer and a non-cross-linked hydrophilic polymer and the amount of said water applied to said dye fixing material is not more than that required to maximally swell the layer coated on said dye fixing material, wherein said non-cross-linked hydrophilic polymer is a polymer which is not cross-linked by a cross-linking agent used in said cross-linked hydrophilic polymer as present in said binder.

2. The process for transferring a diffusible dye to a dye fixing material as claimed in claim 1, wherein said cross-linked polymer comprises monomer units of the following general formula (I):

$$-(A)_x-(B)_y-(C)_z- \quad (I)$$

wherein A represents a monomer unit having a nucleophilic reactive group selected from the group consisting of a primary or secondary amino group, a phenolic hydroxy group, an active methylene group and a sulfinic acid group; B represents a monomer unit having an electrophilic reactive group selected from the group consisting of an aldehyde group, an active halogen group, an active vinyl group, an active ester group, an epoxy group and an N-methylol group; C represents a hydrophilic monomer unit having a hydrophilic group selected from the group consisting of a hydroxy group, a carboxylic acid group, a carboxylic acid salt, an amido group, a sulfonic acid group, a sulfonic acid salt and a lactam group; x is 0 to 50 mol%; y is 0 to 50 mol%; z is 20 to 99 mol%, with the proviso that $x+y \geqq 1$ mol%.

3. The process for transferring a diffusible dye to a dye fixing material as claimed in claim 1, wherein said cross-linked polymer is selected from the group consisting of gelatin and gelatin derivatives.

4. The process for transferring a diffusible dye to a dye fixing material as claimed in claim 1, wherein said non-cross-linked polymer comprises a hydrophilic monomer unit containing a hydrophilic group selected from the group consisting of a hydroxy group, a carboxylic acid group, a carboxylic acid salt, a sulfonic acid group, a sulfonic acid salt and a lactam group, said non-cross-linked polymer being a polymer which is not cross-linked by a cross-linking agent used in said cross-linked hydrophilic polymer as coexisting in said binder.

5. The process for transferring a diffusible dye to a dye fixing material as claimed in claim 1, wherein said non-cross-linked polymer is selected from the group consisting of dextran, gum arabic, polyethylene glycol, homopolymers or copolymers of vinyl monomers having a lactam group in the side chain thereof and homopolymers or copolymers of vinyl alcohol.

6. The process for transferring a diffusible dye to a dye fixing material as claimed in claim 3, wherein said cross-linked hydrophilic polymer contains a cross-linking agent selected from the group consisting of a reactive halogen-containing compound and a reactive olefin-containing compound.

7. The process for transferring a diffusible dye to a dye fixing material as claimed in claim 1, wherein said layer contains said non-cross-linked hydrophilic polymer in an amount of from about 1 to 10 g/m$^2$ and said non-cross-linked polymer comprises about 5 to 70 wt% of all polymers contained in the layer in which the hydrophilic non-cross-linked polymer is incorporated.

8. The process for transferring a diffusible dye to a dye fixing material as claimed in claim 1, wherein said mordant is a polymer containing a vinyl monomer unit having a tertiary amino group or a quaternary ammonium group.

9. A process for transferring a diffusible dye to a dye fixing material as claimed in claim 8, wherein said vinyl monomer unit is selected from the group consisting of the following general formulae (X) to (XIII):

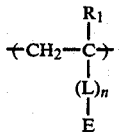

(X)

wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; and n is 0 or 1;

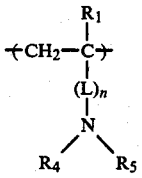

(XI)

wherein $R_1$, L and n have the same meaning as in the above formula (X); $R_4$ and $R_5$ are the same or different and each represents an alkyl group having 1 to 12 carbon atoms or an aralkyl group having 7 to 20 carbon atoms, and $R_4$ and $R_5$ may form, together with the adjacent nitrogen atom, a cyclic structure;

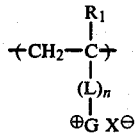

(XII)

wherein $R_1$, L and n have the same meaning as in the above formula (X); $G^{\oplus}$ represents a hetero ring which is quaternized and contains a carbon-nitrogen double bond; and $X^{\ominus}$ represents a monovalent anion; and

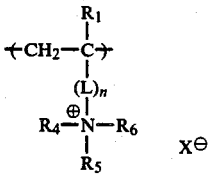

(XIII)

wherein $R_1$, L and n have the same meaning as in the above formula (X); $R_4$ and $R_5$ have the same meaning as in the above formula (XI); $R_6$ has the same definition as $R_4$ and $R_5$; $X^{\ominus}$ has the same meaning as in the above formula (XII); and $R_4$ and $R_5$, $R_5$ and $R_6$, or $R_4$ and $R_6$ may form, together with the adjacent nitrogen atom, a cyclic structure.

* * * * *